US012172043B2

(12) United States Patent
Olander

(10) Patent No.: US 12,172,043 B2
(45) Date of Patent: Dec. 24, 2024

(54) WEIGHTED APPAREL SYSTEMS AND METHODS FOR USE IN PERSONAL FITNESS

(71) Applicant: OMORPHO, Inc., Portland, OR (US)

(72) Inventor: Stefan Olander, Portland, OR (US)

(73) Assignee: OMORPHO, INC., Portland, OR (US)

( * ) Notice: Subject to any disclaimer, the term of this patent is extended or adjusted under 35 U.S.C. 154(b) by 275 days.

(21) Appl. No.: 17/933,451

(22) Filed: Sep. 19, 2022

(65) Prior Publication Data

US 2023/0009796 A1 Jan. 12, 2023

Related U.S. Application Data

(63) Continuation-in-part of application No. 16/834,855, filed on Mar. 30, 2020, now abandoned.

(Continued)

(51) Int. Cl.

| | |
|---|---|
| ***A63B 21/065*** | (2006.01) |
| ***A41D 13/00*** | (2006.01) |
| ***A63B 24/00*** | (2006.01) |

(52) U.S. Cl.

CPC ..... *A63B 21/065* (2013.01); *A41D 13/0015* (2013.01); *A63B 24/0075* (2013.01); *A63B 2225/15* (2013.01); *A63B 2225/50* (2013.01)

(58) Field of Classification Search

CPC ..... A63B 21/065; A63B 24/0075; A63B 2225/15; A63B 2225/50; A63B 21/00065;

(Continued)

(56) References Cited

U.S. PATENT DOCUMENTS

| | | | |
|---|---|---|---|
| 5,286,146 | A | 2/1994 | Corsi |
| 6,209,135 | B1 | 4/2001 | Irvin |

(Continued)

FOREIGN PATENT DOCUMENTS

| | | | |
|---|---|---|---|
| GB | 2462477 | A | 2/2010 |
| WO | 2011117862 | A2 | 9/2011 |

(Continued)

OTHER PUBLICATIONS

Majoka, M et al., "NFC Enabled Smartphone Application for Instant Cognitive Support," Master's Thesis, Master of Science in Computer Science, Blekinge Institute of Technology, School of Computing, May 2012, 72 pages.

(Continued)

*Primary Examiner* — Garrett K Atkinson
(74) *Attorney, Agent, or Firm* — McCoy Russell LLP

(57) ABSTRACT

A system for use in personal fitness can include: an article of clothing configured to be worn by a user during a personal fitness session, the article of clothing having a fabric layer and at least one weighted portion formed by either or both polyurethane (PU) and thermoplastic polyurethane (TPU) printed on the fabric layer; an electronic device having a processor; and a communication unit integrated with the article of clothing and configured to interact with the electronic device, wherein the communication unit includes a near field communication (NFC) device or a QR code, and further wherein the processor is configured to launch a personal fitness application responsive to the user interacting with the NFC device or QR code.

20 Claims, 59 Drawing Sheets

Related U.S. Application Data

(60) Provisional application No. 63/261,335, filed on Sep. 17, 2021, provisional application No. 62/825,479, filed on Mar. 28, 2019.

(58) Field of Classification Search
CPC ..... A63B 2209/08; A63B 21/4005; A63B 21/4007; A63B 21/4009; A63B 71/0622; A63B 2209/10; A63B 2225/54; A63B 21/0603; A41D 13/0015
See application file for complete search history.

(56) References Cited

U.S. PATENT DOCUMENTS 6,557,176 B2 5/2003 Franco-Sion
6,675,391 B2 1/2004 Morrison
6,913,585 B2 7/2005 Salmon et al.
7,000,255 B1 2/2006 Baacke
7,156,792 B2 1/2007 Gibson-Horn
7,490,361 B1 2/2009 Floyd
7,707,652 B2 * 5/2010 Senegal ..... A63B 23/047 2/102
7,870,623 B2 * 1/2011 Judd ..... A63B 21/4007 5/655.4
8,156,572 B2 4/2012 Whaley
8,245,322 B1 8/2012 Bouza
8,253,586 B1 8/2012 Matak
8,262,545 B1 * 9/2012 Beber ..... A63B 21/065 224/264
8,443,465 B2 5/2013 Stewart
8,572,762 B2 11/2013 Herbener et al.
8,800,311 B2 * 8/2014 Raines ..... A61F 7/10 62/259.3
9,072,935 B2 * 7/2015 Ross ..... A63B 23/047
9,132,309 B2 * 9/2015 Bowers ..... A63B 21/0552
9,168,413 B2 * 10/2015 Petrakis ..... A63B 21/065
9,185,964 B2 * 11/2015 Crye ..... A45F 3/047
9,330,558 B2 * 5/2016 Logan ..... H04M 1/72412
9,521,870 B2 * 12/2016 Turner ..... A41D 13/05
9,931,531 B2 * 4/2018 Robinson ..... A63B 21/00065
9,968,141 B2 * 5/2018 Ward ..... A41D 13/0012
10,037,672 B1 * 7/2018 Abraham ..... A61B 5/02055
2006/0090240 A1 5/2006 McKenzie et al.
2007/0173385 A1 7/2007 Cohenca et al.
2008/0280737 A1 11/2008 Cook
2009/0291813 A1 11/2009 Mueller
2011/0274903 A1 * 11/2011 Stuart ..... C08L 75/04 501/32
2012/0151656 A1 * 6/2012 Irwin ..... A63B 21/065 2/102
2012/0290109 A1 * 11/2012 Engelberg ..... G16H 20/30 700/91
2013/0131566 A1 5/2013 Bodansky
2015/0145671 A1 * 5/2015 Cohen ..... G06Q 30/0241 340/539.11
2015/0233778 A1 * 8/2015 Casillas ..... A61B 5/6802 73/865.4
2016/0000640 A1 * 1/2016 Lai ..... G16H 20/30 601/149
2016/0072802 A1 * 3/2016 Hoyos ..... G06F 16/9535 726/5
2016/0367848 A1 * 12/2016 Seuk ..... A63B 21/00065
2017/0157447 A1 * 6/2017 Brown ..... A63B 21/00065
2017/0196277 A1 * 7/2017 Henry ..... A41D 1/08
2017/0325525 A1 * 11/2017 Hyde ..... A61G 7/1051
2018/0161616 A1 * 6/2018 Henneberry ..... A63B 21/065
2018/0193687 A1 * 7/2018 Petrakis ..... A63B 21/4005
2018/0241864 A1 * 8/2018 Males ..... H04B 17/27
2019/0022450 A1 * 1/2019 Martinoli Sanz ..... B32B 5/16
2021/0251802 A1 * 8/2021 Dijkstra ..... A41D 1/002

FOREIGN PATENT DOCUMENTS

WO 2017210514 A1 12/2017
WO 2018226679 A1 12/2018

OTHER PUBLICATIONS

Fernández-Caramés, T et al., "Towards the Internet of Smart Clothing: A Review on IoT Wearables and Garments for Creating Intelligent Connected E-Textiles," Electronics, vol. 7. No. 12, Dec. 7, 2018, 36 pages.

* cited by examiner

WEIGHTED APPAREL SYSTEMS AND METHODS FOR USE IN PERSONAL FITNESS

CROSS REFERENCE TO RELATED APPLICATION

This application is a continuation-in-part application of U.S. patent application Ser. No. 16/834,855, titled "WEIGHTED APPAREL SYSTEMS AND METHODS FOR USE IN PERSONAL FITNESS" and filed on Mar. 30, 2020. U.S. patent application Ser. No. 16/834,855 claims priority to and the benefit of U.S. Provisional Patent Application No. 62/825,479, titled "WEIGHTED APPAREL SYSTEMS AND METHODS FOR USE IN PERSONAL FITNESS" and filed on Mar. 28, 2019. This application also claims priority to and the benefit of U.S. Provisional Patent Application No. 63/261,335, titled "WEIGHTED APPAREL ARTICLE" and filed on Sep. 17, 2021. The contents of each of these applications is hereby incorporated herein in its entirety.

TECHNICAL FIELD

The disclosed technology is generally directed to systems and methods for improved personal fitness. More particularly, implementations generally pertain to articles of clothing that may be weighted by way of integrated portions and/or weighted portions configured to be coupled with an article of clothing.

BACKGROUND

Previously, users would need to hold weighted units, e.g., dumbbells and/or barbells and/or weight plates, to add weighted resistance during a personal fitness session such as a workout. Such additional weights generally require partial or complete commitment by the user's hands to hold the additional weight. Such restrictions undesirably prevent the user from using his or her hands for other purposed during the fitness session, such as holding a water bottle or an electronic device, for example.

Implementations of the disclosed technology address these and other limitations in the prior art.

BRIEF DESCRIPTION OF THE DRAWINGS

Aspects, features and advantages of embodiments of the present disclosure will become apparent from the following description of embodiments in reference to the appended drawings in which.

DESCRIPTION

Implementations of the disclosed technology are generally directed to methods, techniques, and systems for a user to add weight during a personal fitness session, e.g., to increase the personal workload to create physical benefits through such personal training and physical activity. The weights may be either embedded (e.g., by way of weighted yarns and/or fabrics) or added onto a product (e.g., by way of magnetic weight sheets or weighted layers and/or shells) to a portfolio of products such as articles of clothing configured to be worn by a user during personal fitness sessions.

The disclosed implementations represent a new category of functional fitness gear that is based on the insight that adding load onto a user's body while working out maximizes the effect, builds strength and endurance, and burns more calories for the user. Adding the right amount of weight, distributed in the right places, e.g., close to a person's center of gravity, is an under-leveraged, safe, and effective way of getting more out of every activity.

In certain implementations, regular, e.g., weekly or daily, short and effective workouts may be provided by way of the mobile connection embedded in most personal electronic products such as tablets and smartphones. In addition, wearing such products by a user while doing sport/fitness activities maximizes the effect without adding precious time.

Certain embodiments may include a portfolio of visually attractive, modern, and comfortable weighted apparel products configured to be worn for health, wellness, fitness, and training. Such portfolio may include weighted compression tank-tops, t-shirts, long sleeve t-shirts, jackets, and vests, where the weight may be embedded and completely evenly distributed across the product. In certain instances, the fabric itself may deliver the desired weight, in other instances, additional loads may be added in an evenly distributed manner across the garment.

Certain implementations may include a weighted vest where, rather than creating a vest with pockets simply holding weights, the entire vest may be molded into a single stunning piece of equipment, e.g., constructed by encased steel spheres in varying, corresponding dimensions, anatomically, and evenly distributed across the body. These weighted units may be molded in place within a transparent silicone and/or TPU frame, for example.

The closures and straps may be integrated into the piece, making it a visually stunning product with the additional benefits of the piece being easy to clean because the entire piece may be sealed and thus simply washed and/or rinsed off. In certain embodiments, the steel spheres may act as a receiving mechanism for additional weights to be added, e.g., by easily snapping them in place by leveraging corresponding magnets on the supplemental weight sheets.

Figure 1:
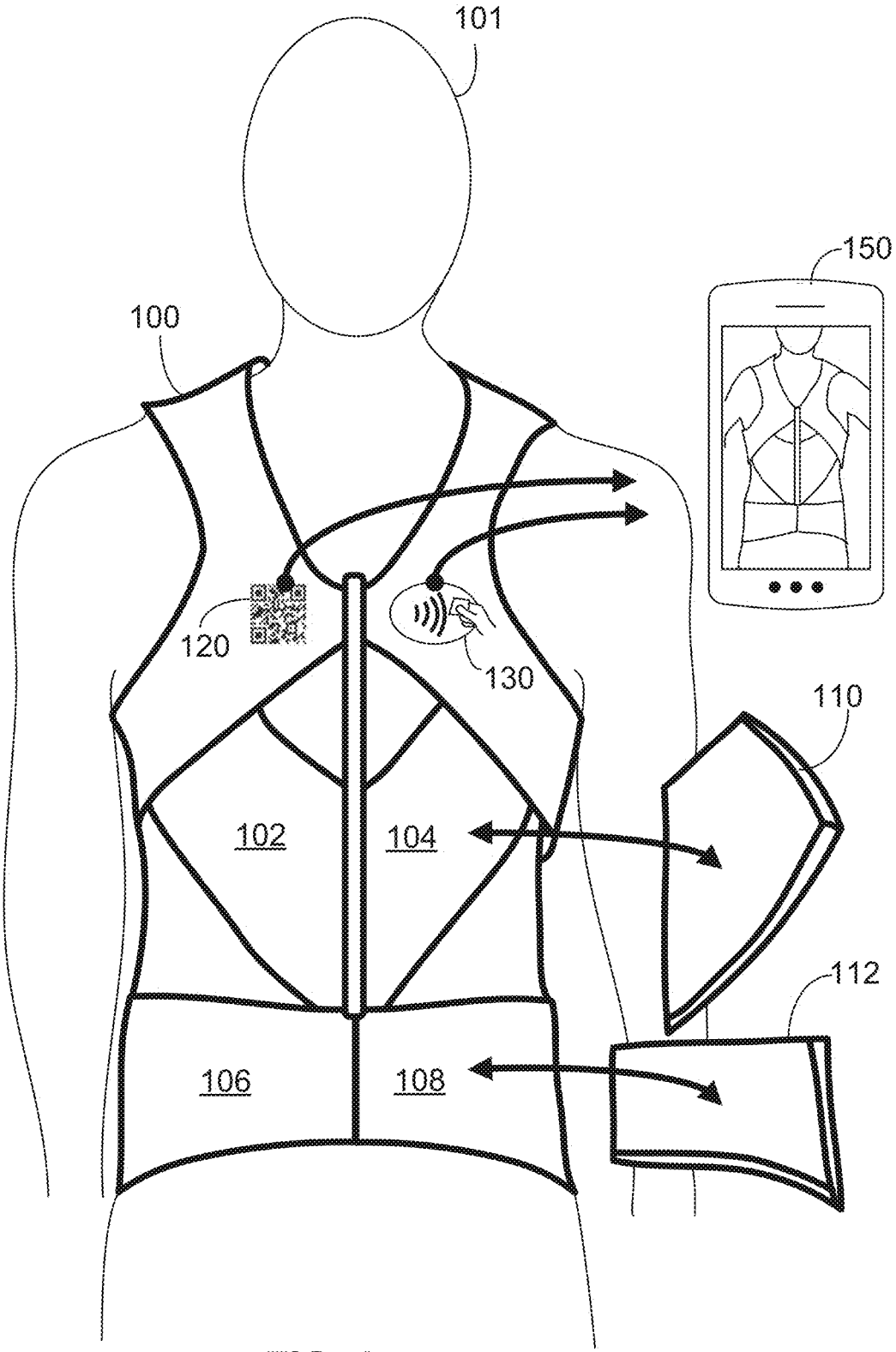
FIG. 1 illustrates a first front view of a first example of a weighted apparel system in accordance with certain implementations of the disclosed technology.

FIG. 1 illustrates a first front view of a first example of a weighted apparel system in accordance with certain implementations of the disclosed technology. In the example, a user 101 is wearing an article of clothing 100 that is configured to be worn by the user 101 during a personal fitness session. The article of clothing 100 may be selected from the following group: a vest, a shirt (e.g., a compression shirt), a pair of pants, a pair of shorts, a jacket, a piece of footwear, and a piece of headwear.

The article of clothing 100 has multiple portions 102, 104, 106, and 108 that each include a coupling mechanism. The example also includes a first weighted unit 110 having a coupling mechanism configured to interact with the coupling mechanism of a corresponding portion 104 of the article of clothing 100 to cause the first weighted unit 110 to remain substantially in place at the portion 104 of the article of clothing 100 during the personal fitness session.

Alternatively or in addition to the article of clothing 100 having the multiple portions 102, 104, 106, and 108, the article of clothing 100 may have a fabric layer and at least one weighted portion that is formed by either or both polyurethane (PU) and thermoplastic polyurethane (TPU) being printed on the fabric layer. The PU/TPU that is printed on the article of clothing 100 may be patterned and/or sized to achieve a desired weight for the user such as, for example, a certain number of ounces or a certain number of pounds.

The example further includes a second weighted unit 112 having a coupling mechanism configured to interact with the coupling mechanism of a corresponding portion 108 of the article of clothing 100 to cause the second weighted unit 112 to remain substantially in place at the portion 108 of the article of clothing 100 during the personal fitness session. It will be appreciated that the user 101 can use either or both first and second weighted units 110 and 112, separately and/or concurrently, during the personal fitness session.

Alternatively or in addition thereto, either or both of the first and second weighted units may include water and/or sand and/or other suitable material(s) to increase the weight of the weighted unit. Further, while the example only includes two weighted units 110 and 112, it will be appreciated that there is virtually no limit to the number of weighted units and/or corresponding portions of the article of clothing 100. Indeed, in certain implementations, a weighted unit may couple on top of another weighted unit such that the user 101 may layer any number of weighted units at any number of corresponding portions on the article of clothing 100. This advantageously provides the user 101 with the ability to progressively increase the weight during his or her personal fitness session.

In the example illustrated by FIG. 1, the article of clothing 100 also includes two communication units 120 and 130 that are each configured to interact with an electronic device 150 such as a personal computing device, e.g., a tablet or smartphone or other suitable piece of hardware. Here, the first communication unit 120 is a QR code and the second communication unit 130 is a near field communication (NFC) device.

Figure 2:
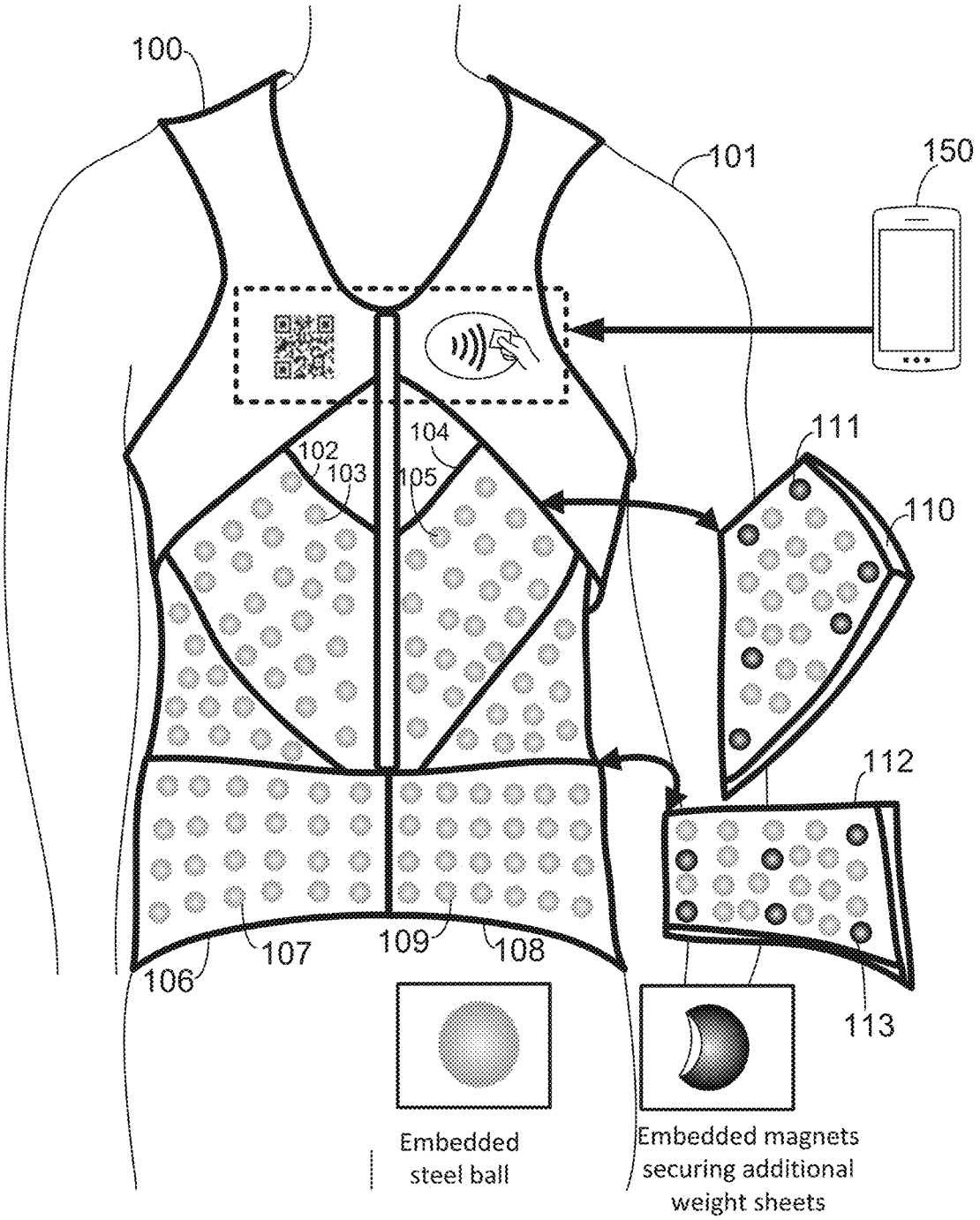
FIG. 2 illustrates a second front view of the first example of a weighted apparel system in accordance with certain implementations of the disclosed technology.

FIG. 2 illustrates a second front view of the first example of a weighted apparel system in accordance with certain implementations of the disclosed technology. In the example, the coupling mechanisms of the portions 102, 104, 106, and 108 of the article of clothing 100 each include a plurality of metal units such as ball bearings 103, 105, 17, and 109, for example.

The ball bearings 103, 105, 17, and 109 may be made of steel and/or other suitable material(s) such as cast iron, for example. In certain embodiments, the plurality of metal units may be embedded within the article of clothing 100 at the designated corresponding portion 103, 105, 17, and 109.

In certain implementations, the ball bearings 103, 105, 17, and 109 may be enclosed spherical-shaped weights that are situated or otherwise positioned between two layers of PU-coated textiles by way of any or all of the following techniques: compression, RF welding, and ultrasonic methods. Such embodiments are advantageously flexible, soft, washable, and generally more appealing than other embodiments such as silicone/TPU alone, for example.

In the example, the first weighted unit 110 includes a plurality of magnetic units, e.g., magnet 111, that are arranged and configured to magnetically couple with the plurality of metal units, e.g., ball bearing 105, of the corresponding portion 104 of the article of clothing 100.

Also in the example, the second weighted unit 112 includes a plurality of magnetic units, e.g., magnet 113, that are arranged and configured to magnetically couple with the plurality of metal units, e.g., ball bearing 109, of the corresponding portion 108 of the article of clothing 100.

It will be appreciated that in alternative embodiments, the coupling mechanism of the first weighted unit 110 may include a plurality of metal units, e.g., ball bearings, and the coupling mechanism of the corresponding portion 104 of the article of clothing 100 may include a plurality of magnetic units that are arranged and configured to magnetically couple with the plurality of metal units of the first weighted unit 110.

Alternatively or in addition thereto, the coupling mechanism of the second weighted unit 112 may include a plurality of metal units, e.g., ball bearings, and the coupling mechanism of the corresponding portion 108 of the article of clothing 100 may include a plurality of magnetic units that are arranged and configured to magnetically couple with the plurality of metal units of the first weighted unit 112.

In certain implementations, either or both of the first and second weighted units 110 and 112 may be made of either or both thermoplastic polyurethane (TPU) and silicone. In such embodiments, the plurality of metal units of the weighted units 110 and 112 may be embedded within the TPU and/or silicon.

Figure 3:
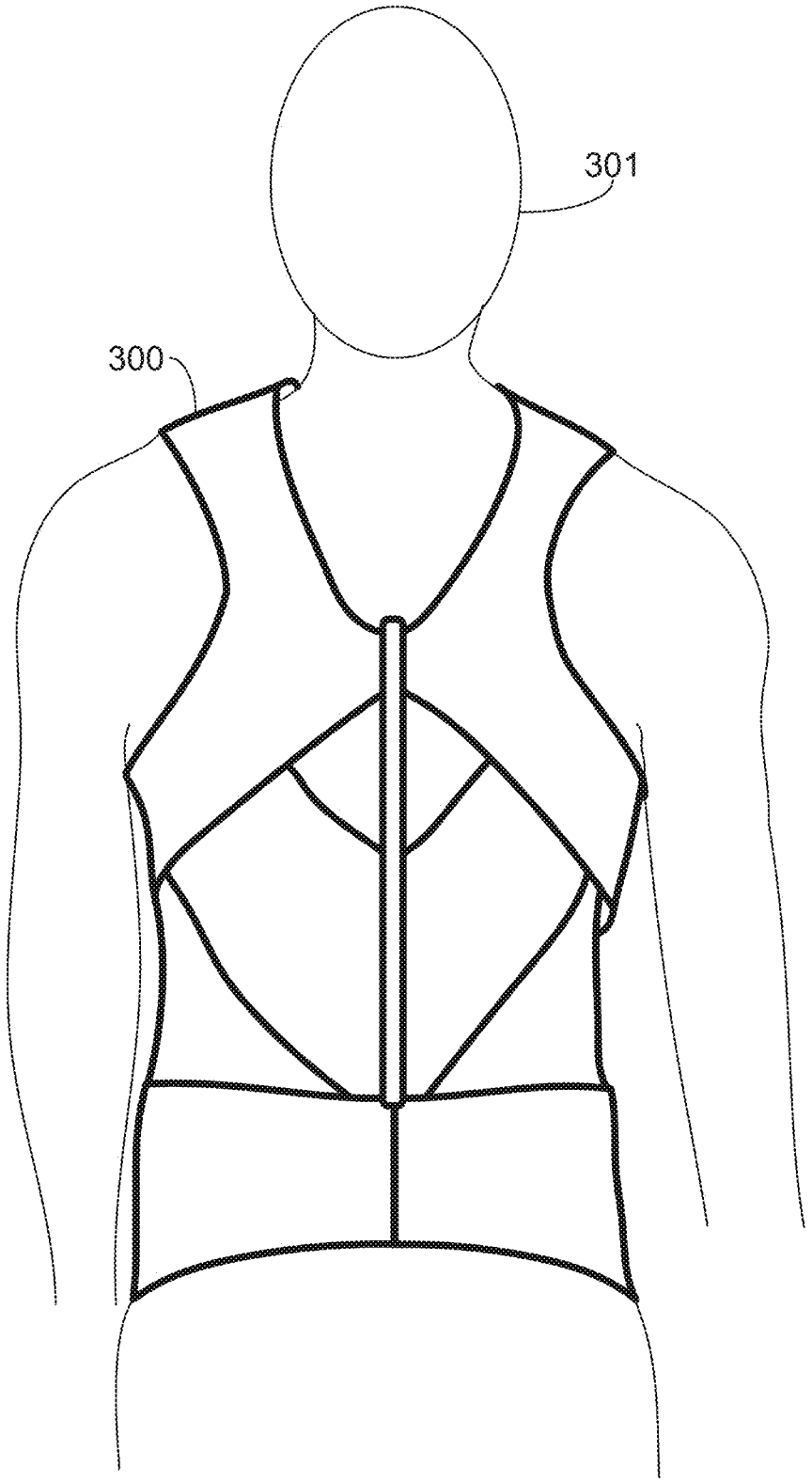
FIG. 3 illustrates a front view of a second example of a weighted apparel system in accordance with certain implementations of the disclosed technology.

FIG. 3 illustrates a front view of a second example of a weighted apparel system in accordance with certain implementations of the disclosed technology. In the example, the user 301 is wearing an article of clothing 300 that may be configured to couple with any number of weighted units so that the user 301 may actively increase—or decrease—the amount of additional weight on his or her body during a workout.

Figure 4:
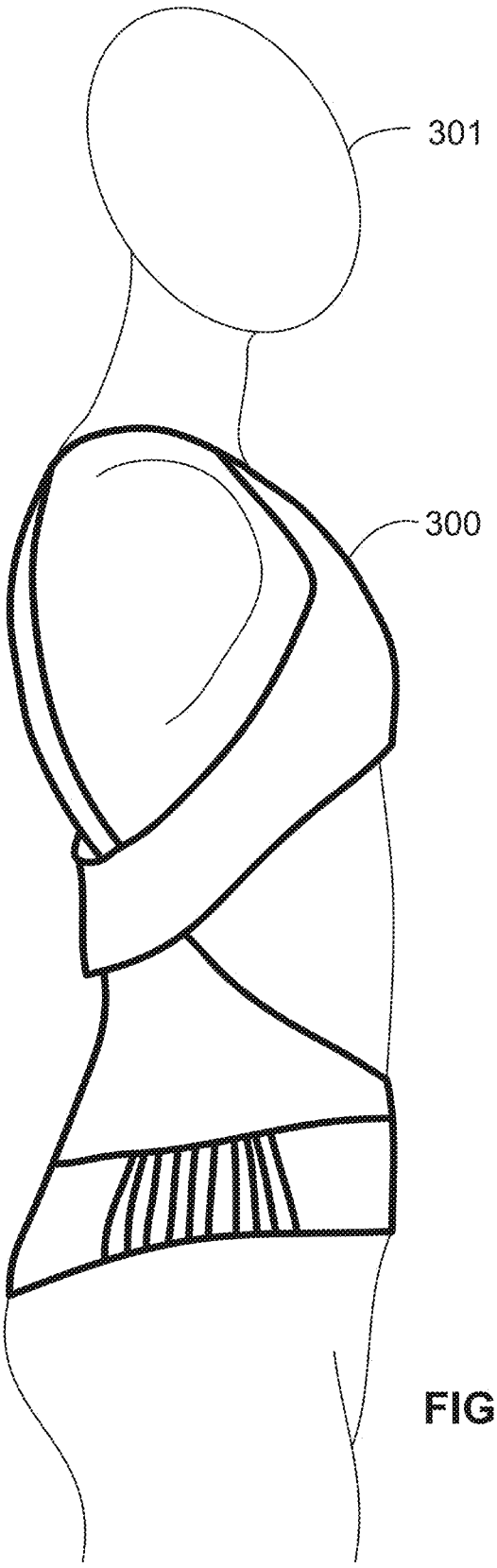
FIG. 4 illustrates a side view of the second example of a weighted apparel system in accordance with certain implementations of the disclosed technology.

FIG. 4 illustrates a side view of the second example of a weighted apparel system, including the article of clothing 300 worn by the user 301, in accordance with certain implementations of the disclosed technology.

Figure 5:
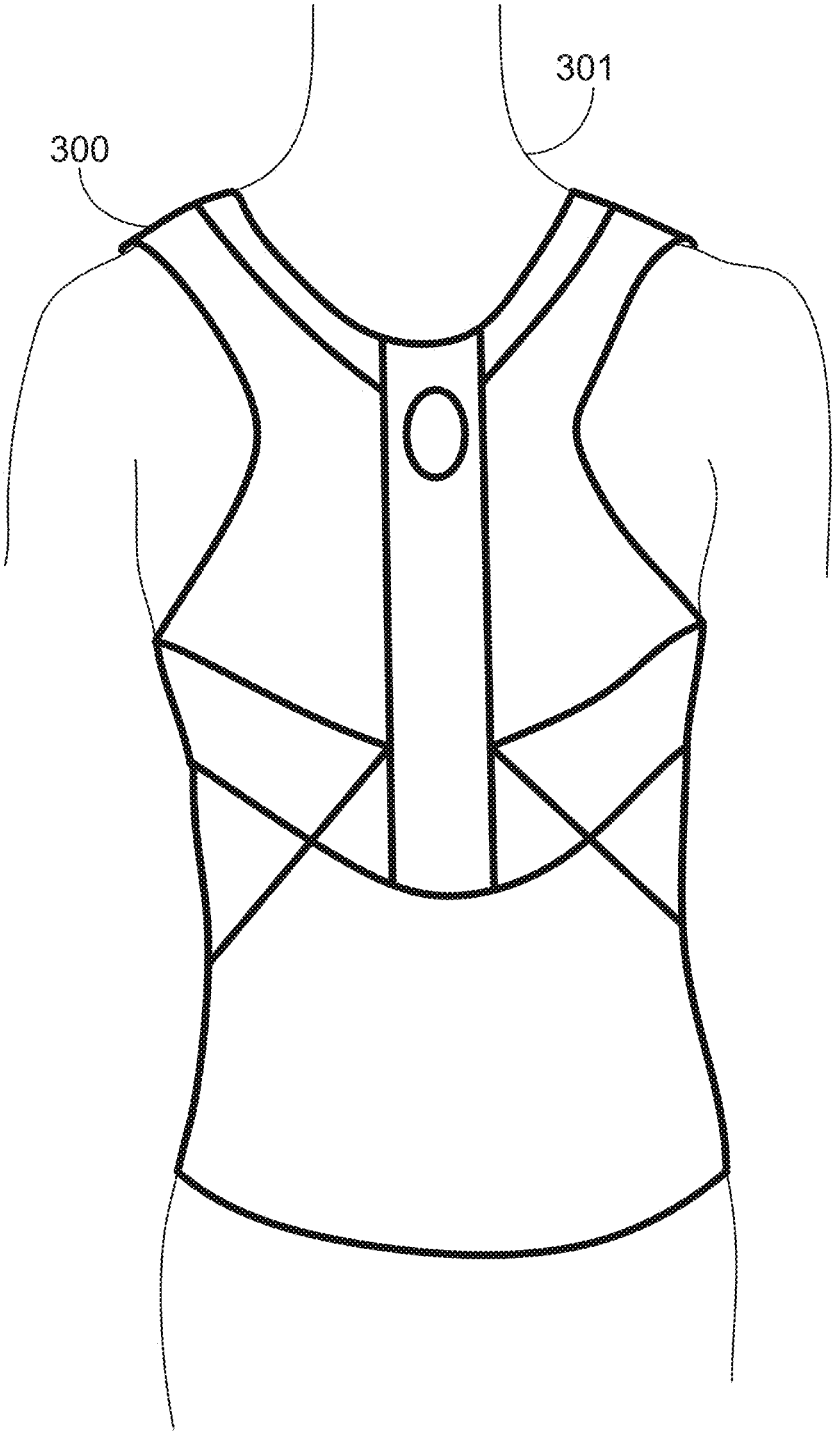
FIG. 5 illustrates a back view of the second example of a weighted apparel system in accordance with certain implementations of the disclosed technology.

FIG. 5 illustrates a back view of the second example of a weighted apparel system, including the article of clothing 300 worn by the user 301, in accordance with certain implementations of the disclosed technology.

Figure 6:
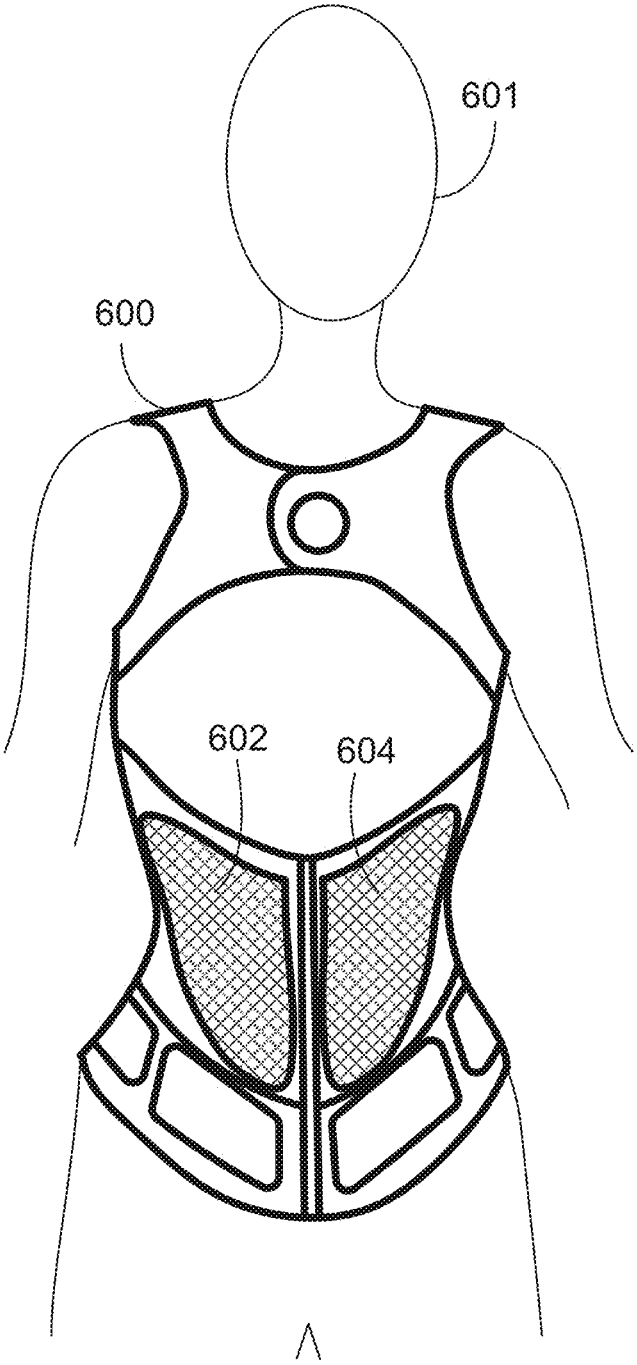
FIG. 6 illustrates a front view of a third example of a weighted apparel system in accordance with certain implementations of the disclosed technology.

FIG. 6 illustrates a front view of a third example of a weighted apparel system in accordance with certain implementations of the disclosed technology. In the example, a user 601 is wearing an article of clothing 600 that is configured to be worn by the user 601 during a personal fitness session.

In the example, the article of clothing 600 has multiple portions 602 and 604 that each include a coupling mechanism, e.g., to allow a corresponding weighted unit having a coupling mechanism configured to interact with the coupling mechanism of a corresponding portion of the article of clothing 600 to remain substantially in place at the corresponding portion of the article of clothing 600 during the personal fitness session.

Figure 7:
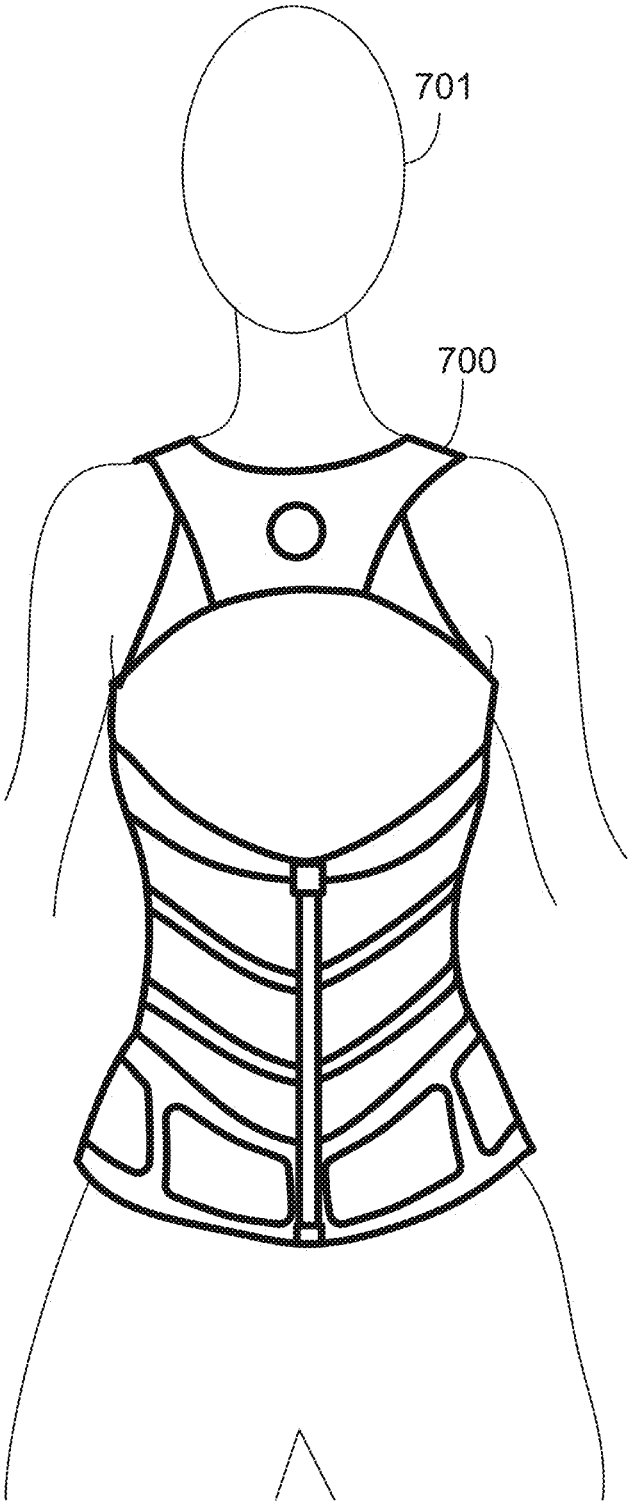
FIG. 7 illustrates a front view of a fourth example of a weighted apparel system in accordance with certain implementations of the disclosed technology.

FIG. 7 illustrates a front view of a fourth example of a weighted apparel system, including an article of clothing 700 worn by a user 701, in accordance with certain implementations of the disclosed technology.

Figure 8:
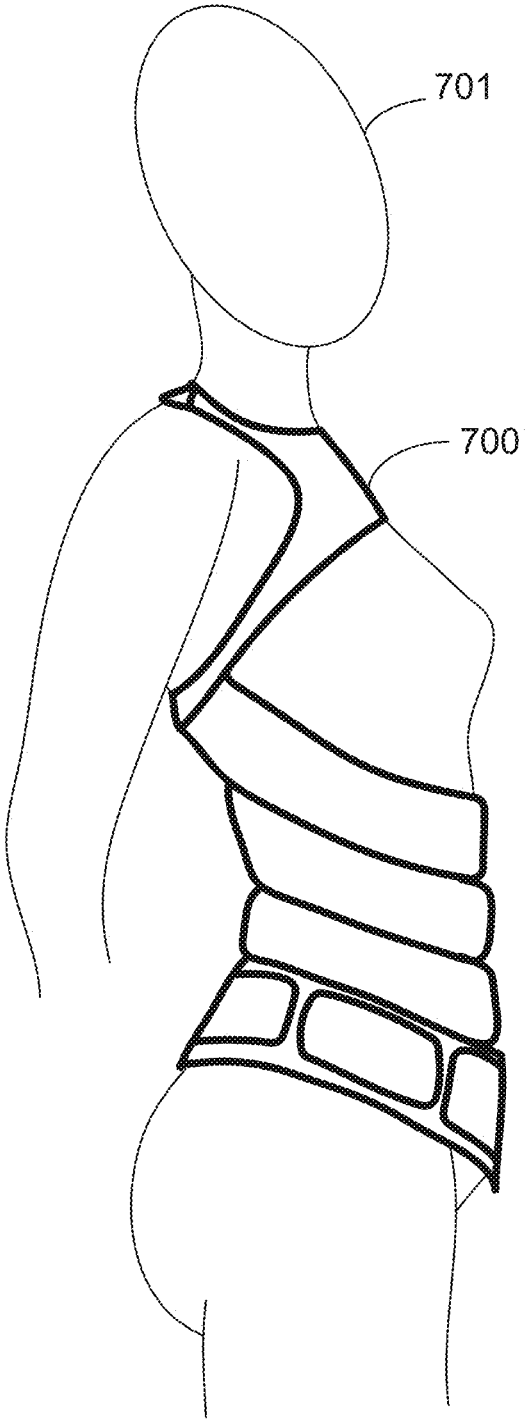
FIG. 8 illustrates a side view of the fourth example of a weighted apparel system in accordance with certain implementations of the disclosed technology.

FIG. 8 illustrates a side view of the fourth example of a weighted apparel system, including the article of clothing 700 worn by the user 701, in accordance with certain implementations of the disclosed technology.

Figure 9:
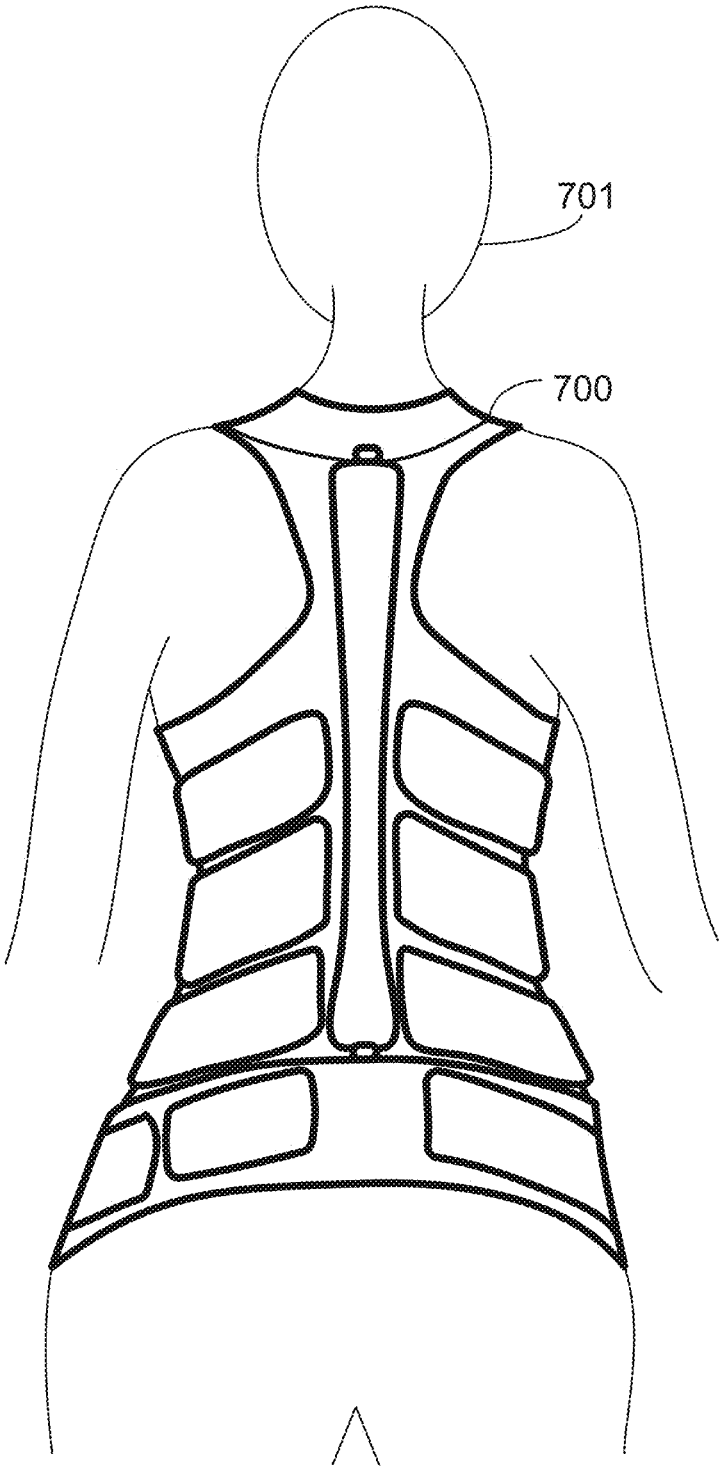
FIG. 9 illustrates a back view of the fourth example of a weighted apparel system in accordance with certain implementations of the disclosed technology.

FIG. 9 illustrates a back view of the fourth example of a weighted apparel system, including the article of clothing 700 worn by the user 701, in accordance with certain implementations of the disclosed technology.

Figure 10:
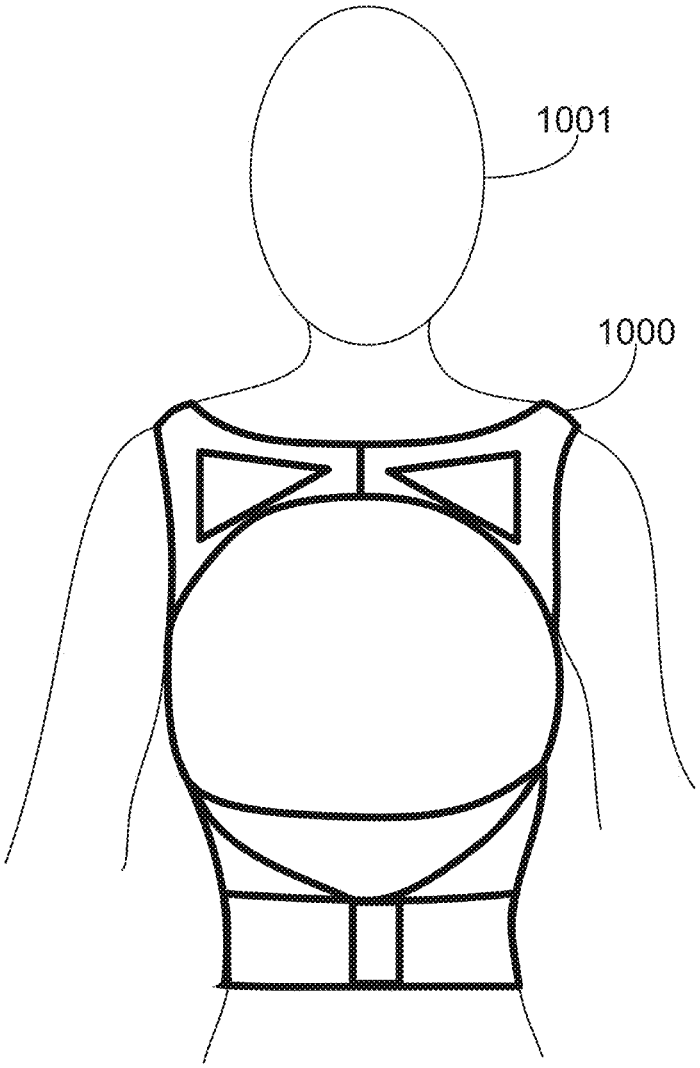
FIG. 10 illustrates a front view of a fifth example of a weighted apparel system in accordance with certain implementations of the disclosed technology.

FIG. 10 illustrates a front view of a fifth example of a weighted apparel system, including an article of clothing 1000 worn by a user 1001, in accordance with certain implementations of the disclosed technology.

Figure 11:
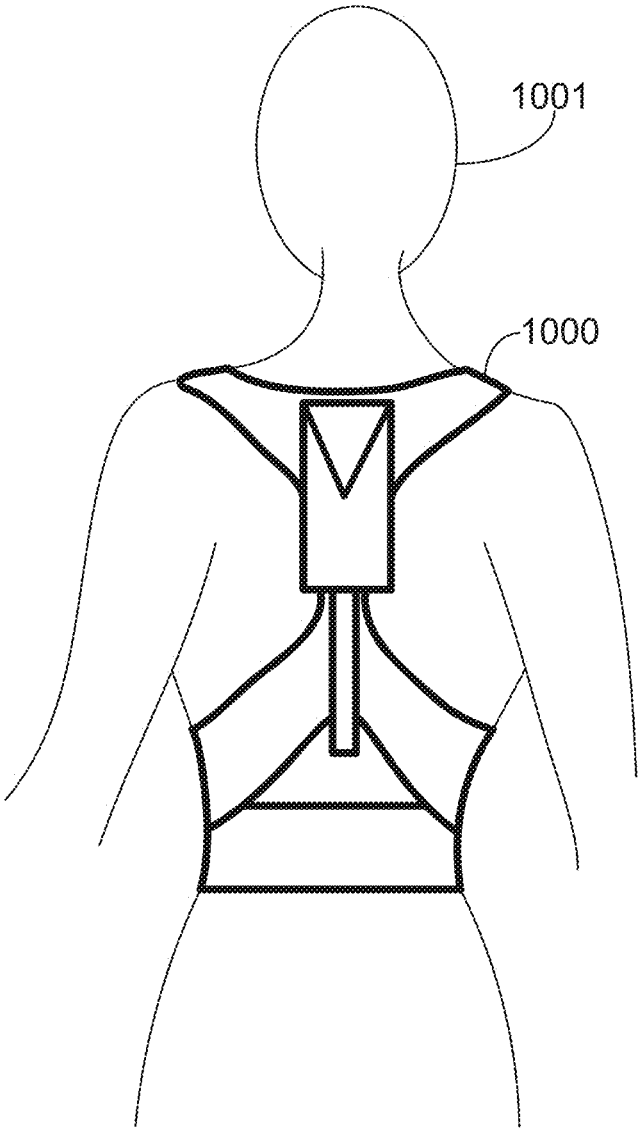
FIG. 11 illustrates a back view of the fifth example of a weighted apparel system in accordance with certain implementations of the disclosed technology.

FIG. 11 illustrates a back view of the fifth example of a weighted apparel system, including the article of clothing 1000 worn by the user 1001, in accordance with certain implementations of the disclosed technology.

Figure 12:
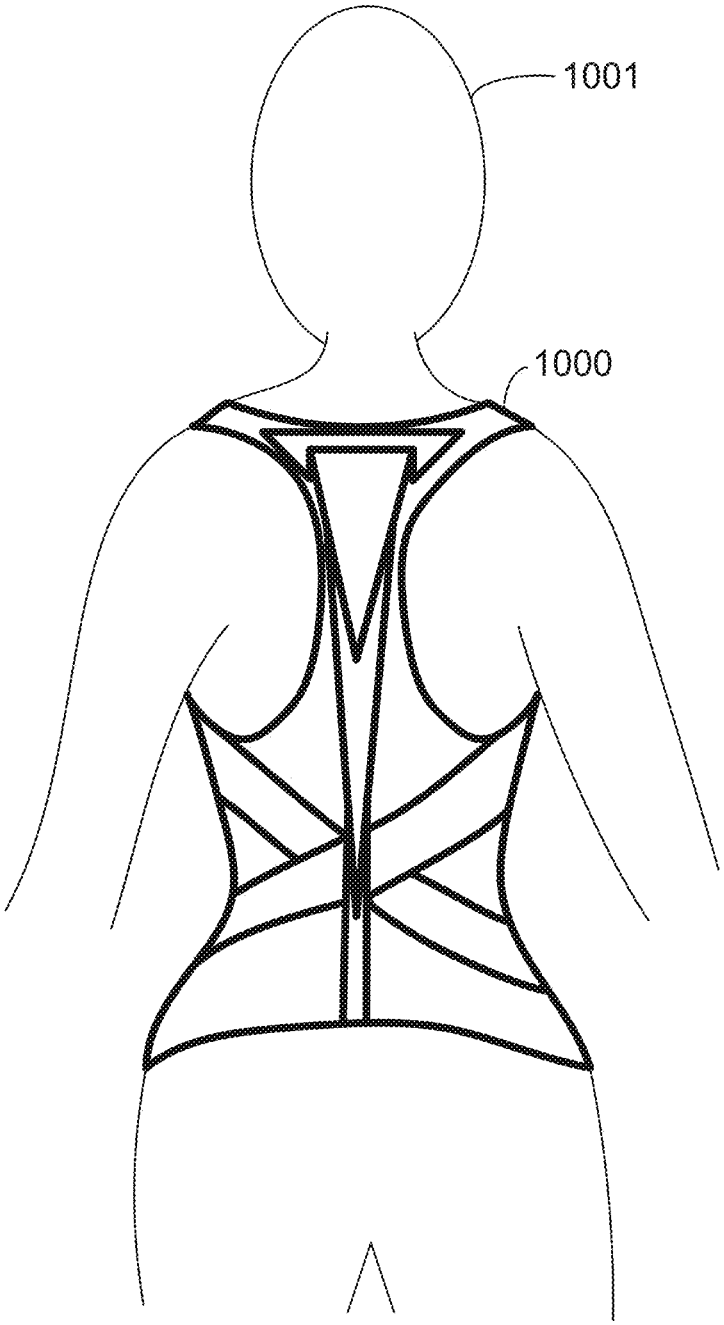
FIG. 12 illustrates an alternate back view of the fifth example of a weighted apparel system in accordance with certain implementations of the disclosed technology.

FIG. 12 illustrates an alternate back view of the fifth example of a weighted apparel system, including the article of clothing 1000 worn by the user 1001, in accordance with certain implementations of the disclosed technology.

Figure 13:
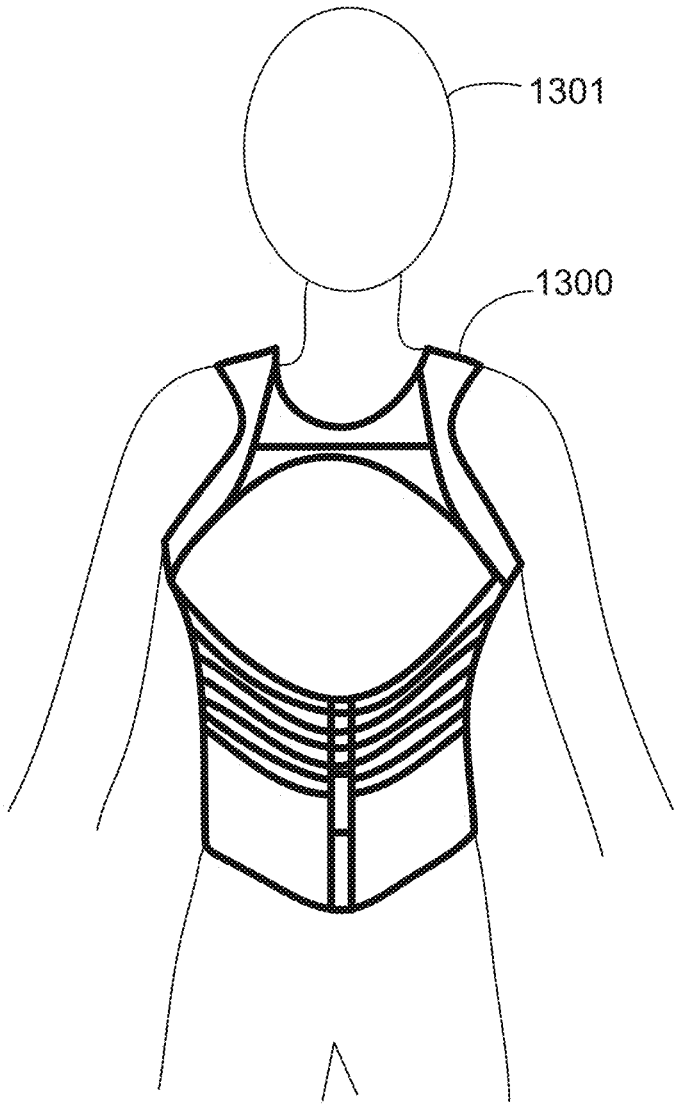
FIG. 13 illustrates a front view of a sixth example of a weighted apparel system in accordance with certain implementations of the disclosed technology.

FIG. 13 illustrates a front view of a sixth example of a weighted apparel system, including an article of clothing 1300 worn by a user 1301, in accordance with certain implementations of the disclosed technology.

Figure 14:
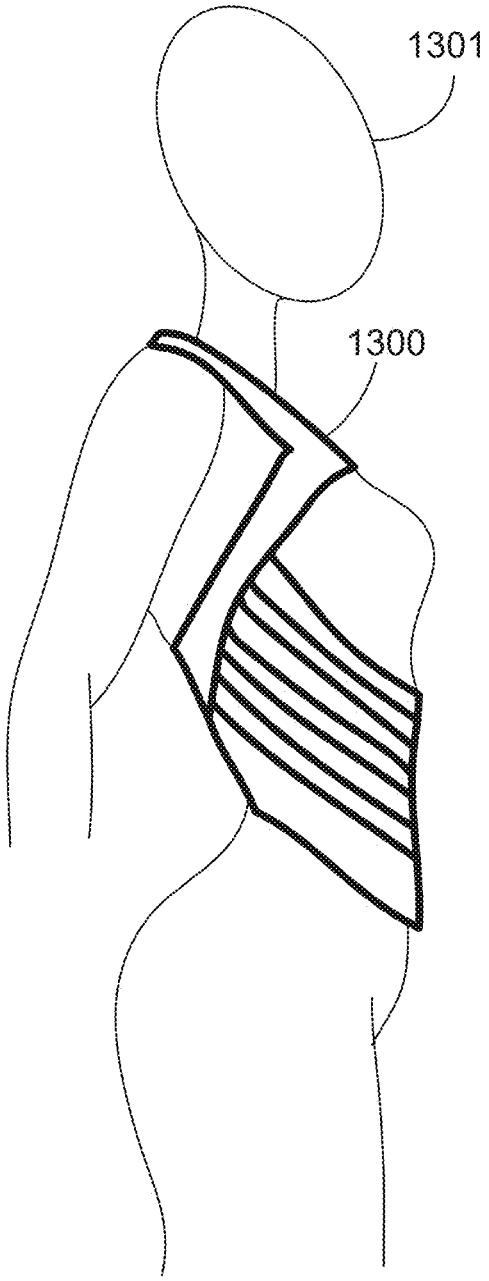
FIG. 14 illustrates a side view of the sixth example of a weighted apparel system in accordance with certain implementations of the disclosed technology.

FIG. 14 illustrates a side view of the sixth example of a weighted apparel system, including the article of clothing 1300 worn by the user 1301, in accordance with certain implementations of the disclosed technology.

Figure 15:
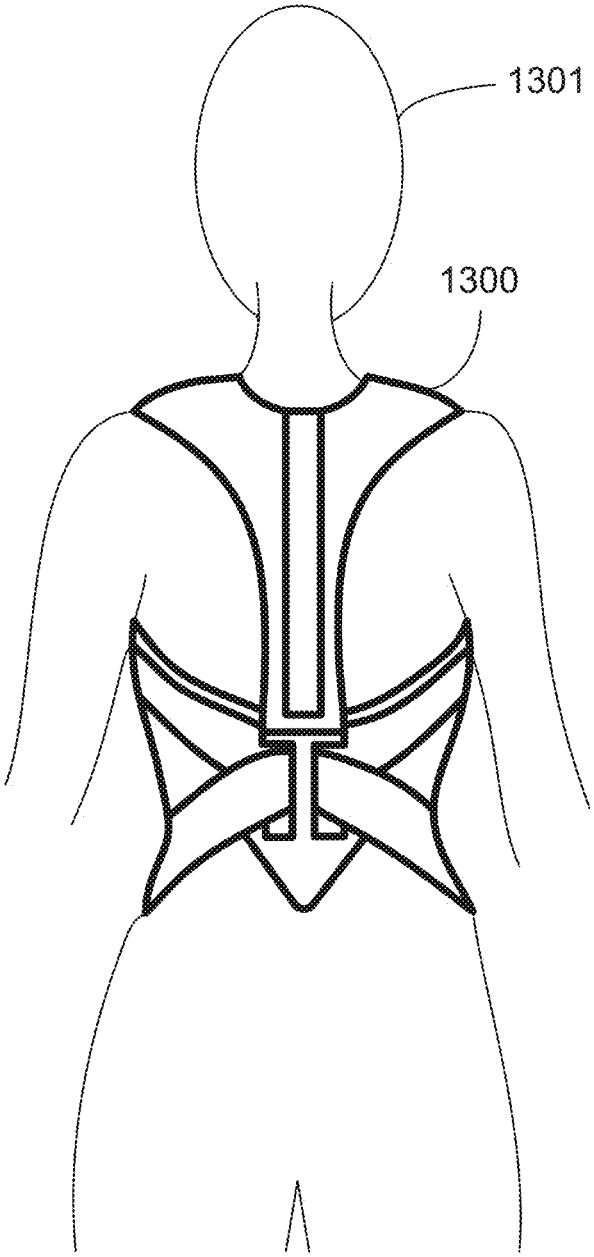
FIG. 15 illustrates a back view of the sixth example of a weighted apparel system in accordance with certain implementations of the disclosed technology.

FIG. 15 illustrates a back view of the sixth example of a weighted apparel system, including the article of clothing 1300 worn by the user 1301, in accordance with certain implementations of the disclosed technology.

Figure 16:
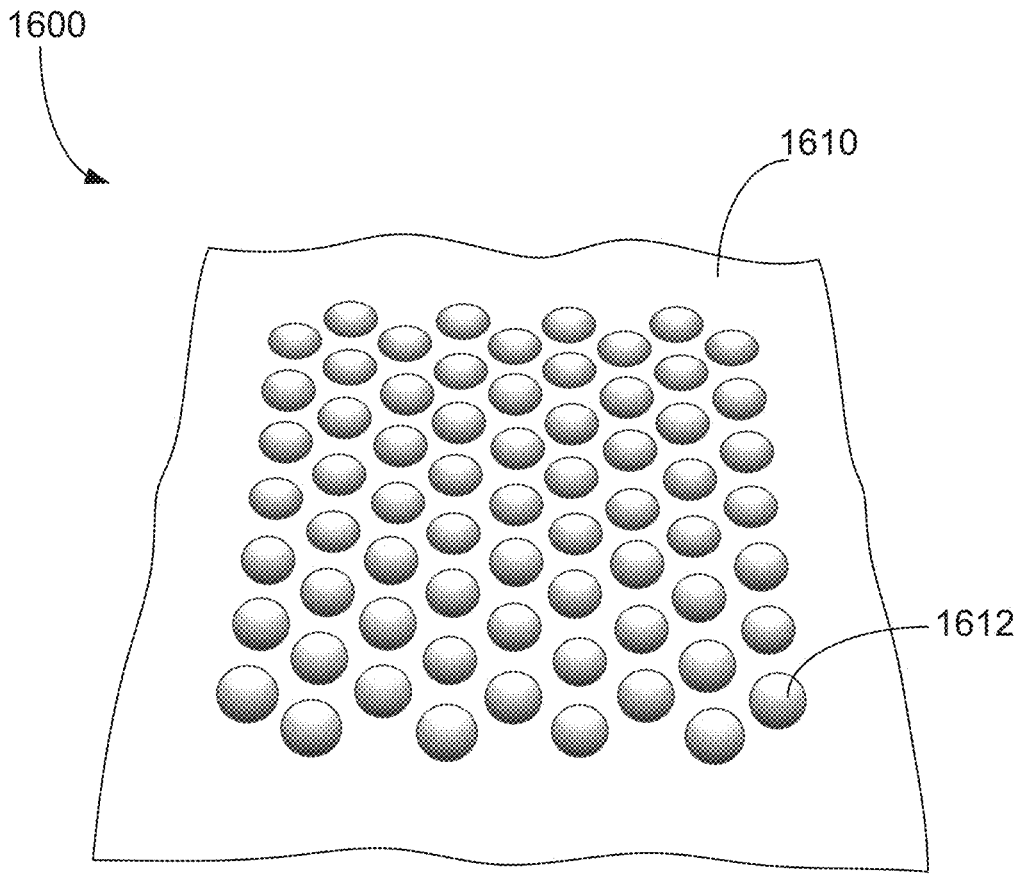
FIG. 16 illustrates a first example of a weighted portion of a weighted apparel system in accordance with certain implementations of the disclosed technology.

FIG. 16 illustrates a first example of a weighted portion 1600, such as the weighted portions 110 and 112 illustrated by FIG. 1, of a weighted apparel system in accordance with certain implementations of the disclosed technology. In the example, the weighted portion 1600 includes a main part 1610, that is made of silicone or other suitable material, and a plurality of units, e.g., 1612, that are formed from the main part 1610.

Figure 17:
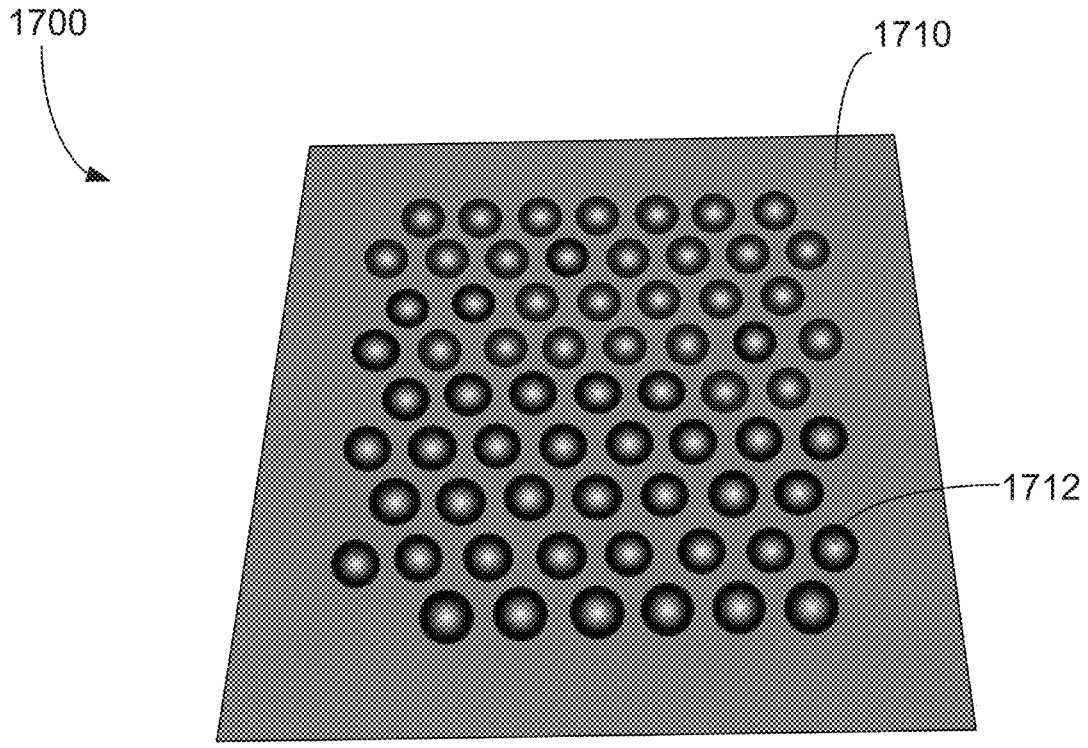
FIG. 17 illustrates a second example of a weighted portion of a weighted apparel system in accordance with certain implementations of the disclosed technology.

FIG. 17 illustrates a second example of a weighted portion 1700, such as the weighted portions 110 and 112 illustrated by FIG. 1, of a weighted apparel system in accordance with certain implementations of the disclosed technology. In the example, the weighted portion 1700 includes a main part 1710, that may be made of fabric, silicone, or other suitable material, and a plurality of units, e.g., ball bearing 1712, that are integrated with, e.g., woven into, the main part 1710.

In certain alternative embodiments, an article of clothing configured to be worn by a user during a personal fitness session may have at least one weighted portion, e.g., made of either or both steel and silicone, that is integrated with the article of clothing. The weighted portion(s) may include heavy yarn that is knitted into the article of clothing. Alternatively or in addition thereto, the weighted portion(s) may include a plurality of ball bearings that are knitted into the article of clothing. Alternatively or in addition thereto, the weighted portion may include a plurality of weighted tubes that are knitted into the article of clothing.

Figure 18:
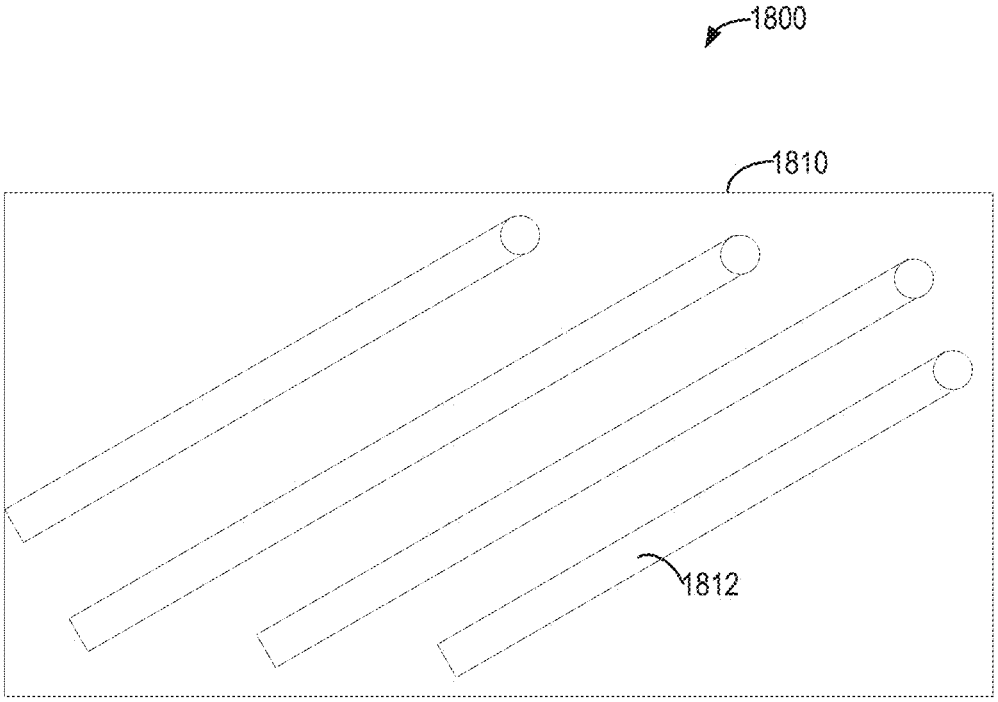
FIG. 18 illustrates an example of a weighted article of clothing in accordance with certain implementations of the disclosed technology.

FIG. 18 illustrates an example 1800 of a weighted article of clothing 1810 in accordance with certain implementations of the disclosed technology. In the example 1800, the weighted article of clothing 1810 includes a plurality of units, e.g., tube 1812, that are integrated with, e.g., woven into, the article of clothing 1810.

Alternatively or in addition thereto, the article of clothing 1810 may be a long-sleeve compression shirt, or other suitable top, having micro-weights evenly distributed therein. The micro-weights may have a weight of 1-2 pounds, for example.

In certain implementations, the user's electronic device may be configured to launch at least one selected from a group consisting of the following: real-time coaching, a training program, and a connection with at least one other user. Upon tapping a mobile phone to an NFC tag, for example, a connection may be established allowing the user to A) Identify, and pair each individual product; B) Register the unique product with us to receive personal additional content, services and offers; C) Unlock daily, live workouts optimized for use with our weighted apparel portfolio; and D) Connect to every other user of the product, thereby creating a unique community opportunity.

Figure 19:
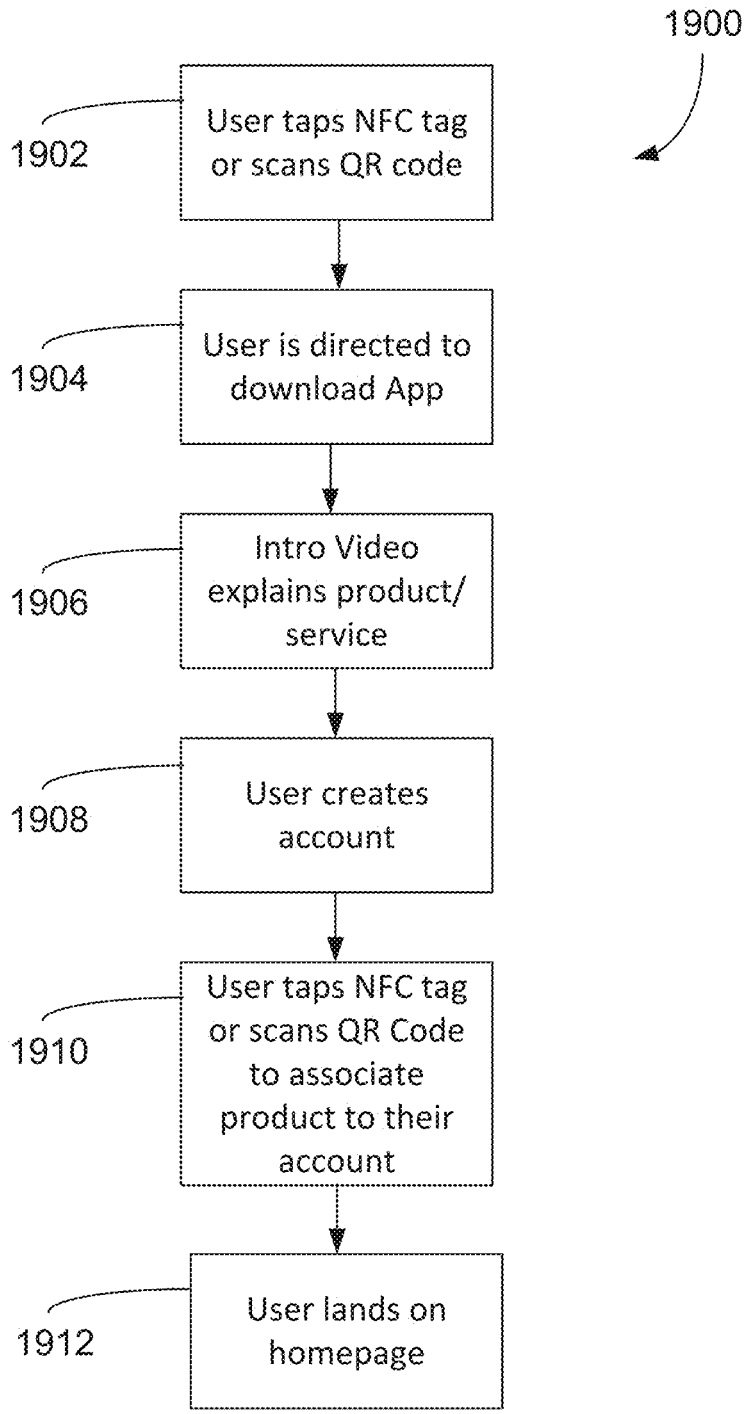
FIG. 19 is a flowchart illustrating an example of a method for using a weighted apparel system in accordance with certain implementations of the disclosed technology.

FIG. 19 is a flowchart illustrating an example of a method 1900 for using a weighted apparel system in accordance with certain implementations of the disclosed technology. At 1902, a user taps a near-field communication (NFC) tag or scans a QR code on an article of clothing configured to be worn by the user during a personal fitness session. At 1904, the system directs the user to download the corresponding application (App) on his or her electronic device, such as a smartphone, tablet computing device, laptop computer, or other suitable personal electronic device, unless such App had been previously downloaded by the user and installed on the electronic device.

At 1906, the system may present to the user an introductory video that explains the pertinent product(s) and/or service(s). This step is optional and may be skipped or otherwise bypassed by the user, e.g., in the event that the user has already watched the video and does not desire to watch it again.

At 1908, the system may prompt the user to create a personal account. This step may be skipped or otherwise bypassed if the user has already created an account and is still logged into such account on the App, for example.

At 1910, the user taps the NFC tag and/or scans the QR code to associate the pertinent product, e.g., the article of clothing, to the user's account. This results in the system causing the user to land on the App's homepage, as indicated at 1912.

Certain implementations may include a LIVE page, where live sessions may be delivered up to—or even over— 5 times per day. Each session may be 10-15 minutes and led by a professional instructor, for example, and designed to maximize the results from working out with added weights.

Completed live session statistics may be saved to the user's account. Users may be logged in to the session to see how many other users are online. The instructor may also see which users are live and encourage participants with real-time shout-outs, for example (e.g., with user consent).

Alternatively or in addition thereto, the App may include a SESSIONS page that has a user's saved "offline" workouts, e.g., from previous personal fitness sessions, that may be accessed and/or used by the user anytime.

Alternatively or in addition thereto, the App may include a ME/account page that may include any or all of the following: the user's workout history, account information, product information, and personal preferences.

It will be appreciated that not every embodiment necessarily includes all of the individual steps 1902-1912. It will be further appreciated that, in certain embodiments, some or all of the steps 1902-1912 may occur in an order that is different from the order in which they are presented by FIG. 19.

In certain implementations, the App on the electronic device may provide a user interface that includes identification information corresponding to the user and multiple other users, e.g., workout partners and/or personal friends that have connected with the user by way of the App. The App may also provide any or all of the following options for the user: to watch a workout session live ("LIVE"); to watch previously recorded workout sessions ("SESSIONS"); to shop for items such as weighted apparel and/or other articles of clothing ("SHOP"); and to communicate with or otherwise contact another person such as a personal trainer ("BEN" in the example).

Figure 20:
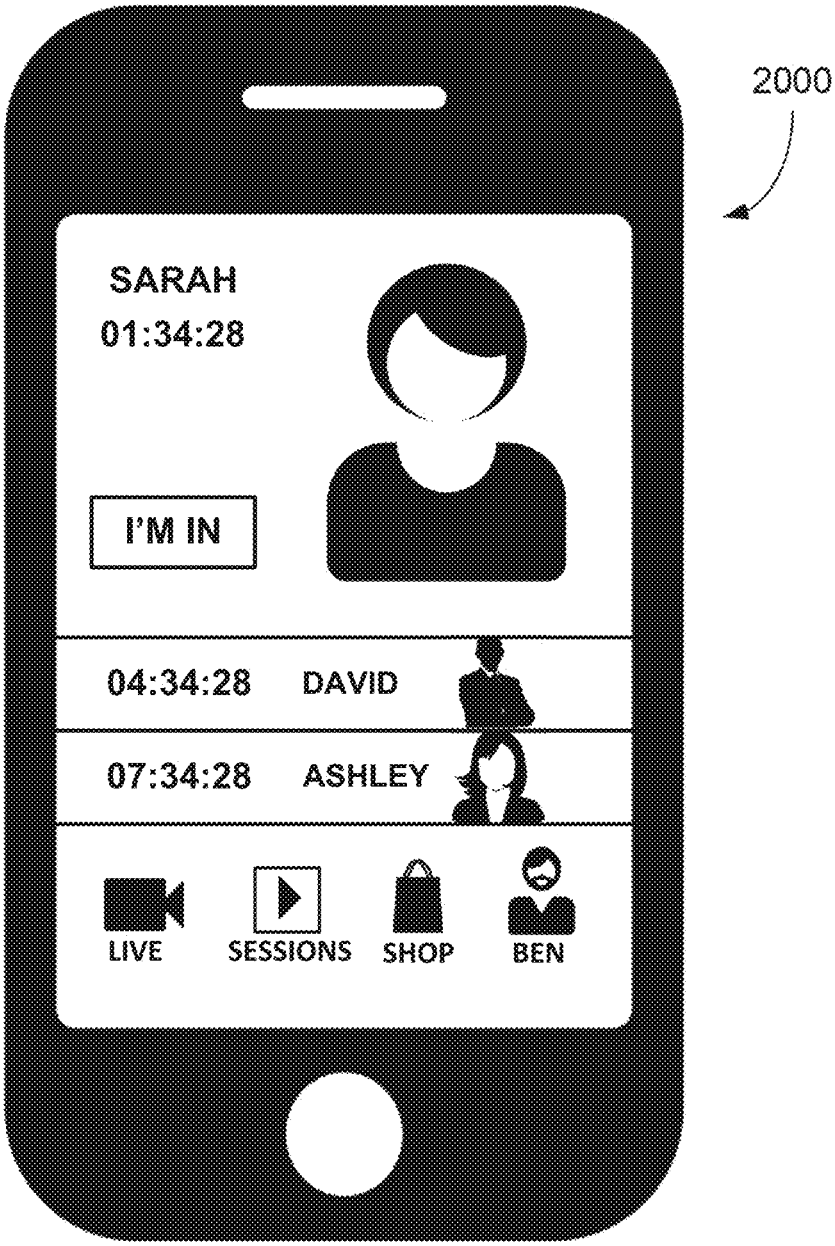
FIG. 20 illustrates a first screenshot of an application for a weighted apparel system in accordance with certain implementations of the disclosed technology.

FIG. 20 illustrates a first screenshot 2000 of an application for a weighted apparel system in accordance with certain implementations of the disclosed technology. In the example, the screenshot 2000 includes. In the example, the screenshot 2000 results from the user selecting the "LIVE" option, and includes information pertaining to a live workout session, e.g., an "I'm In" feature to allow the user to participate in the session, and identification information pertaining to either or both the instructor/trainer and one or more other participating users.

Figure 21:
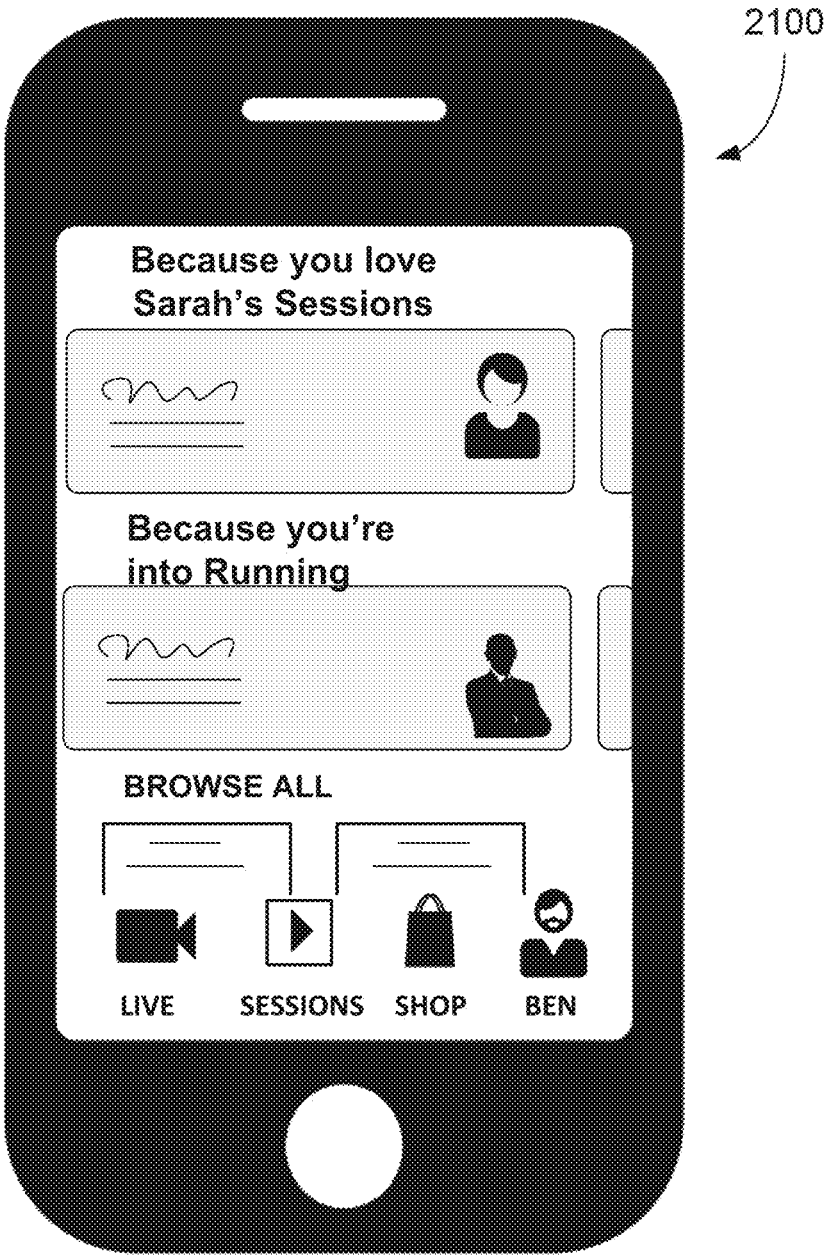
FIG. 21 illustrates a second screenshot of an application for a weighted apparel system in accordance with certain implementations of the disclosed technology.

FIG. 21 illustrates a second screenshot 2100 of the application for a weighted apparel system in accordance with certain implementations of the disclosed technology. In the example, the screenshot 2100 results from the user selecting the "SESSIONS" option, and includes at least one suggested workout session by a certain person, e.g., trainer, which is selected by the App based at least in part on the trainers responsible for the user's previous workouts through the App. In the example, the user has previously accessed one ore more workouts through the App that were led by and/or provided by a trainer named Sarah so the screenshot 2100 provides the user with at least one workout session by Sarah.

In the example, the screenshot 2100 also includes at least one suggested workout session that is selected by the App based at least in part on what types of workout sessions the user has previously accessed through the App. In the example, the user has previously accessed running-related workouts through the App so the screenshot 2100 provides the user with at least one running-related workout session.

Figure 22:
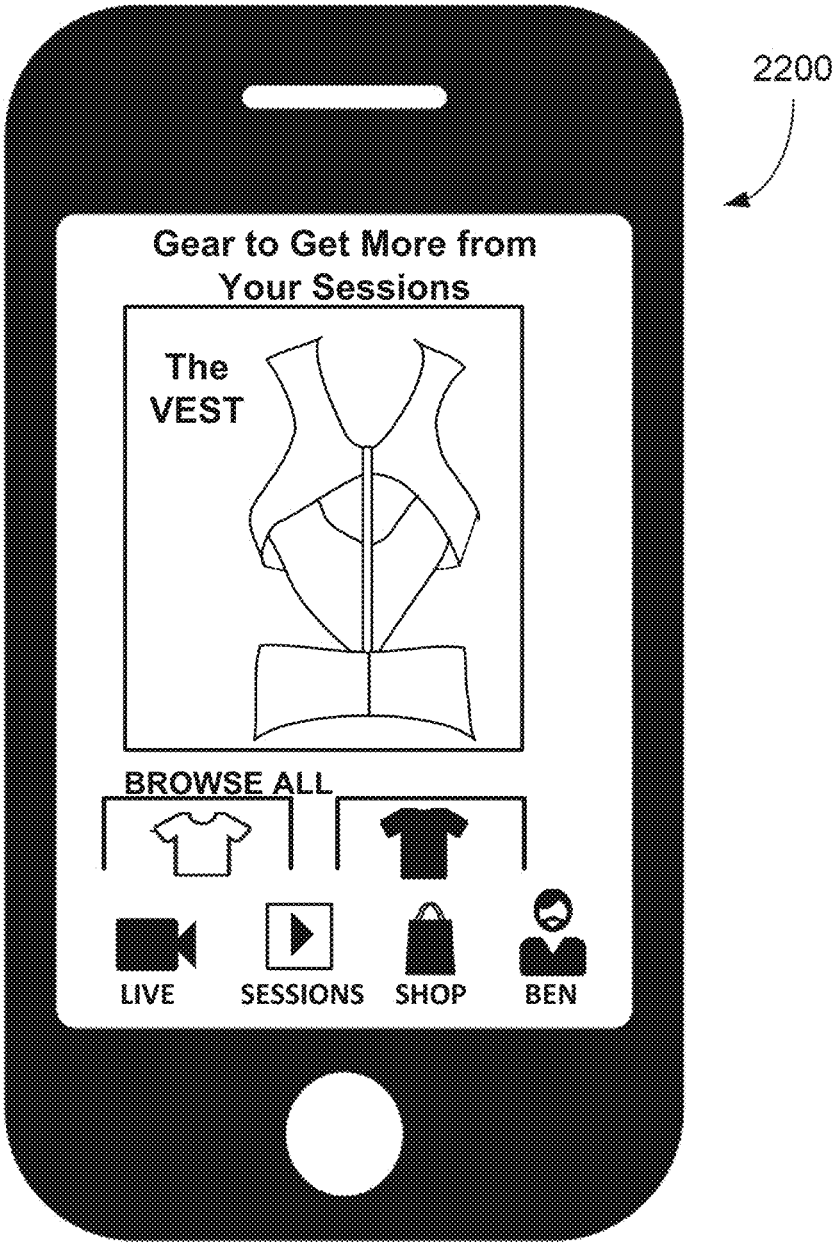
FIG. 22 illustrates a third screenshot of an application for a weighted apparel system in accordance with certain implementations of the disclosed technology.

FIG. 22 illustrates a third screenshot 2200 of the application for a weighted apparel system in accordance with certain implementations of the disclosed technology. In the example, the screenshot 2200 results from the user selecting the "SHOP" option, and provides the user with an interface that the user may use to browse, select, and purchase items such as weighted apparel or other articles of clothing such as those described herein.

Figure 23:
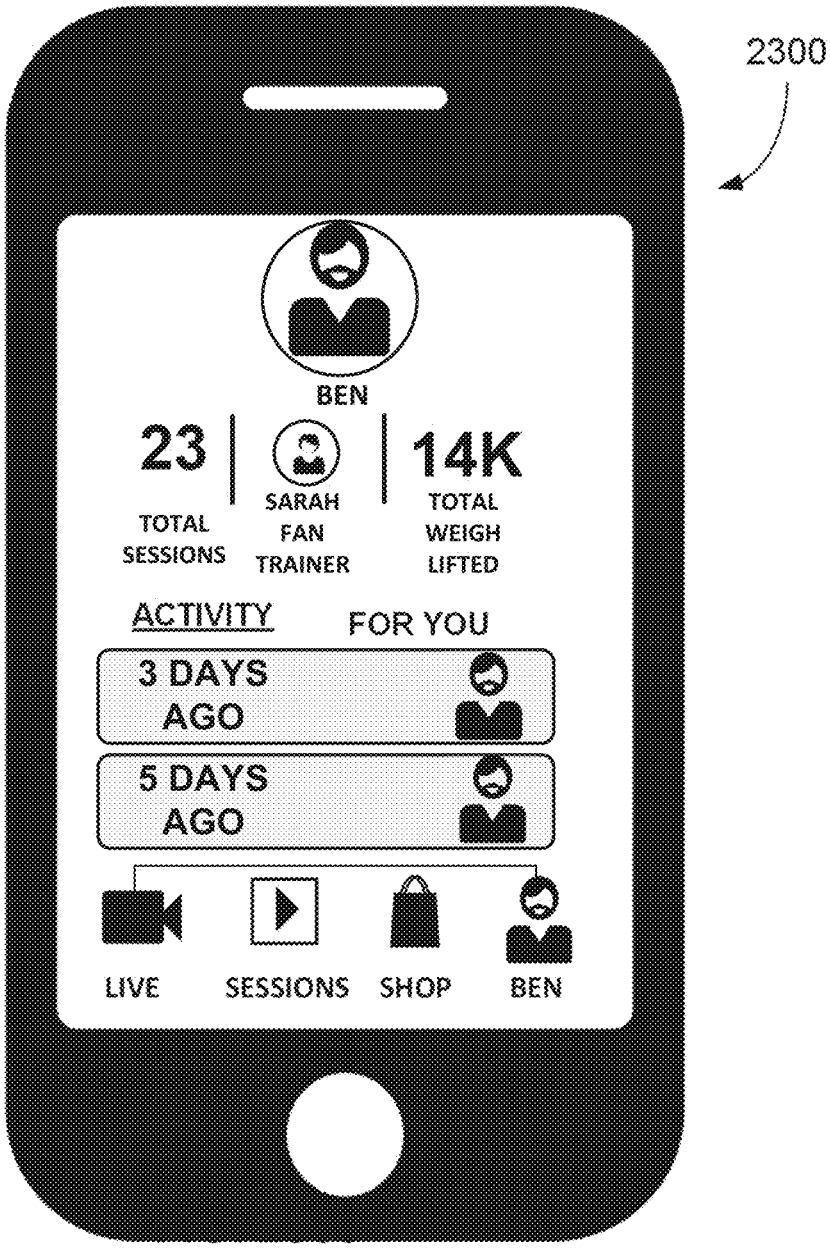
FIG. 23 illustrates a fourth screenshot of an application for a weighted apparel system in accordance with certain implementations of the disclosed technology.

FIG. 23 illustrates a fourth screenshot 2300 of the application for a weighted apparel system in accordance with certain implementations of the disclosed technology. In the example, the screenshot 2300 results from the user selecting the "BEN" option, and provides the user with various types of information pertaining to the trainer and fitness activity associated with the trainer.

Figure 24:
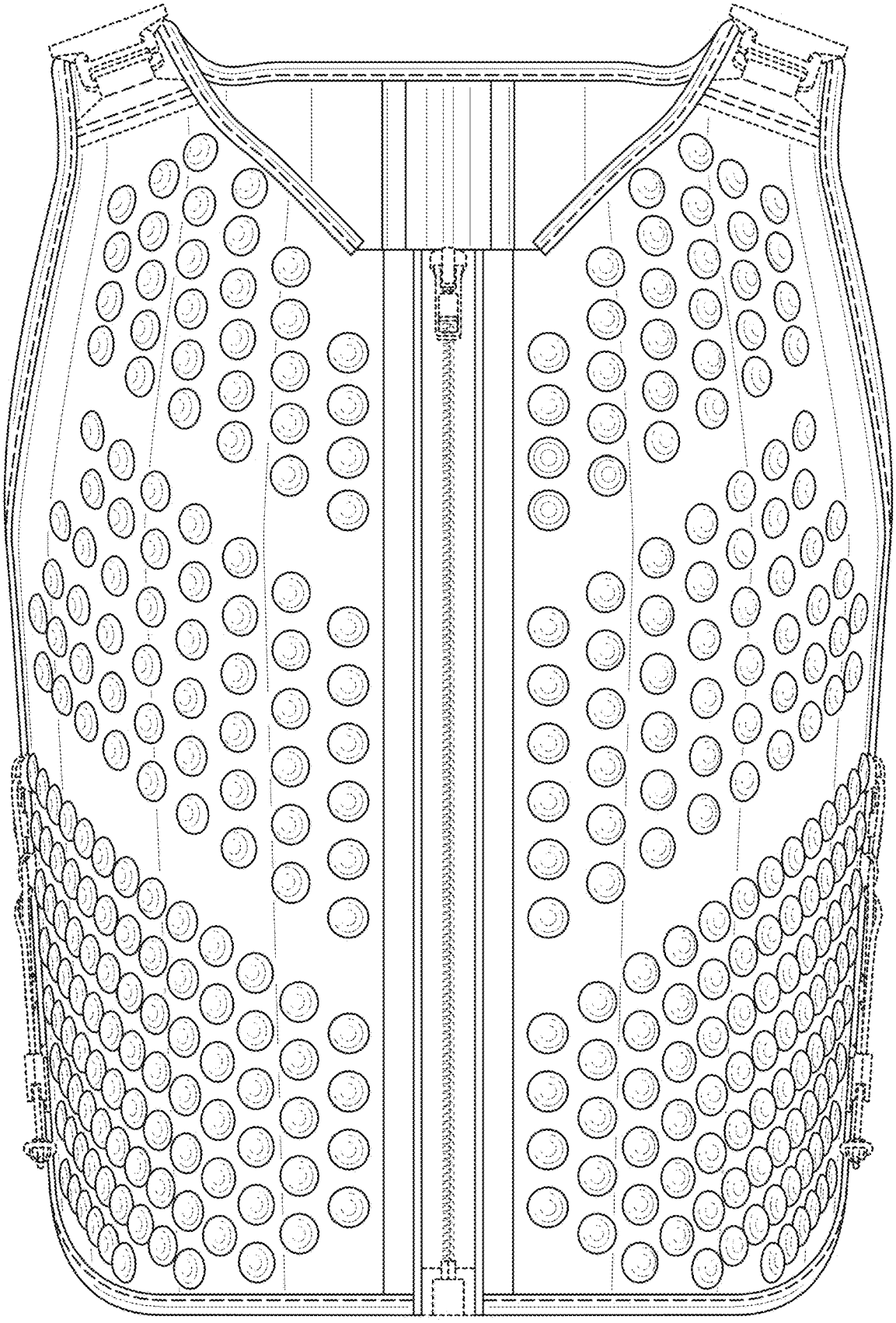
FIG. 24 illustrates a front view of a first example of a weighted apparel article in accordance with certain implementations of the disclosed technology.

FIG. 24 illustrates a front view of a first example of a weighted apparel article in accordance with certain implementations of the disclosed technology.

Figure 25:
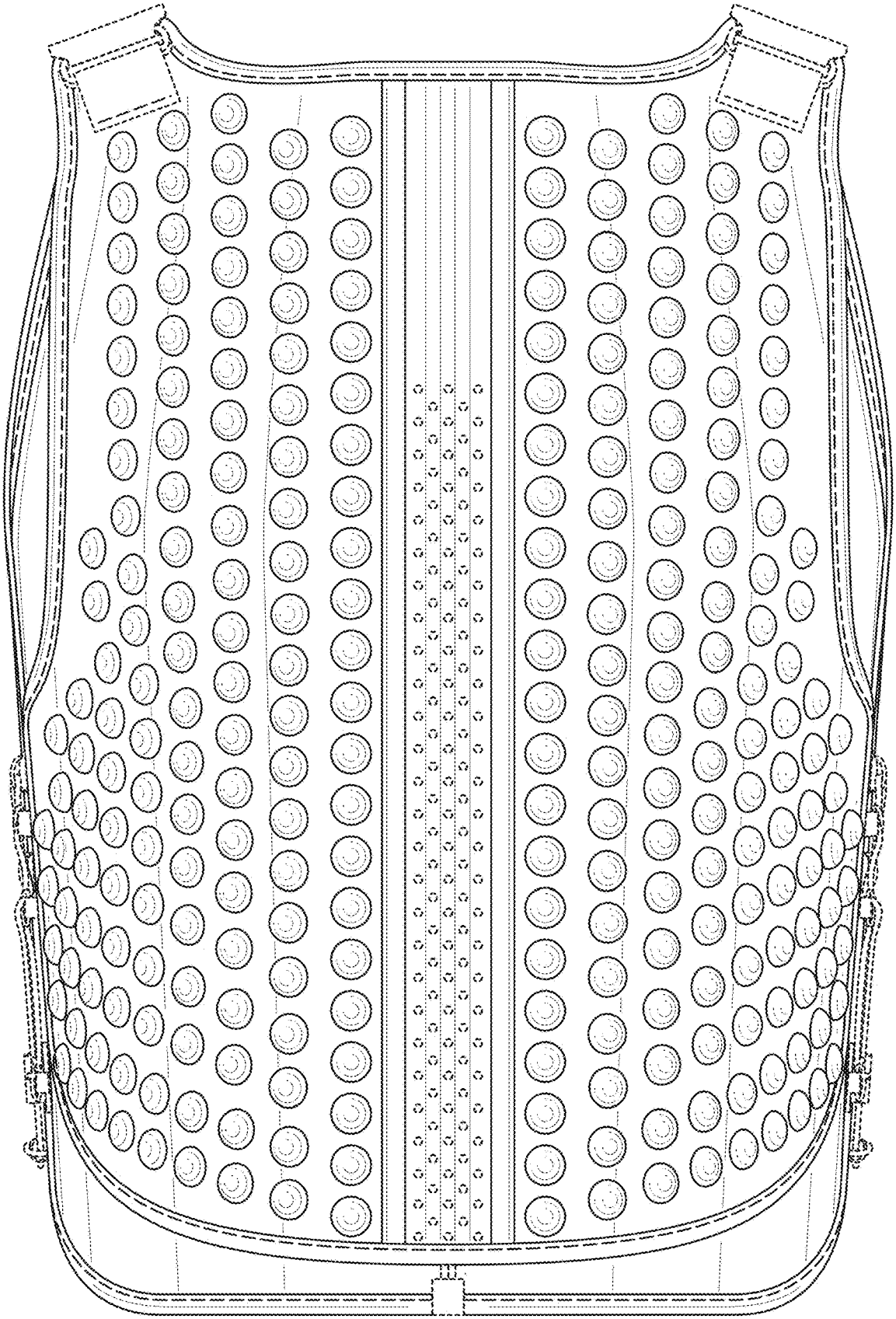
FIG. 25 illustrates a rear view of the weighted apparel article illustrated by FIG. 24.

FIG. 25 illustrates a rear view of the weighted apparel article illustrated by FIG. 24.

Figure 26:
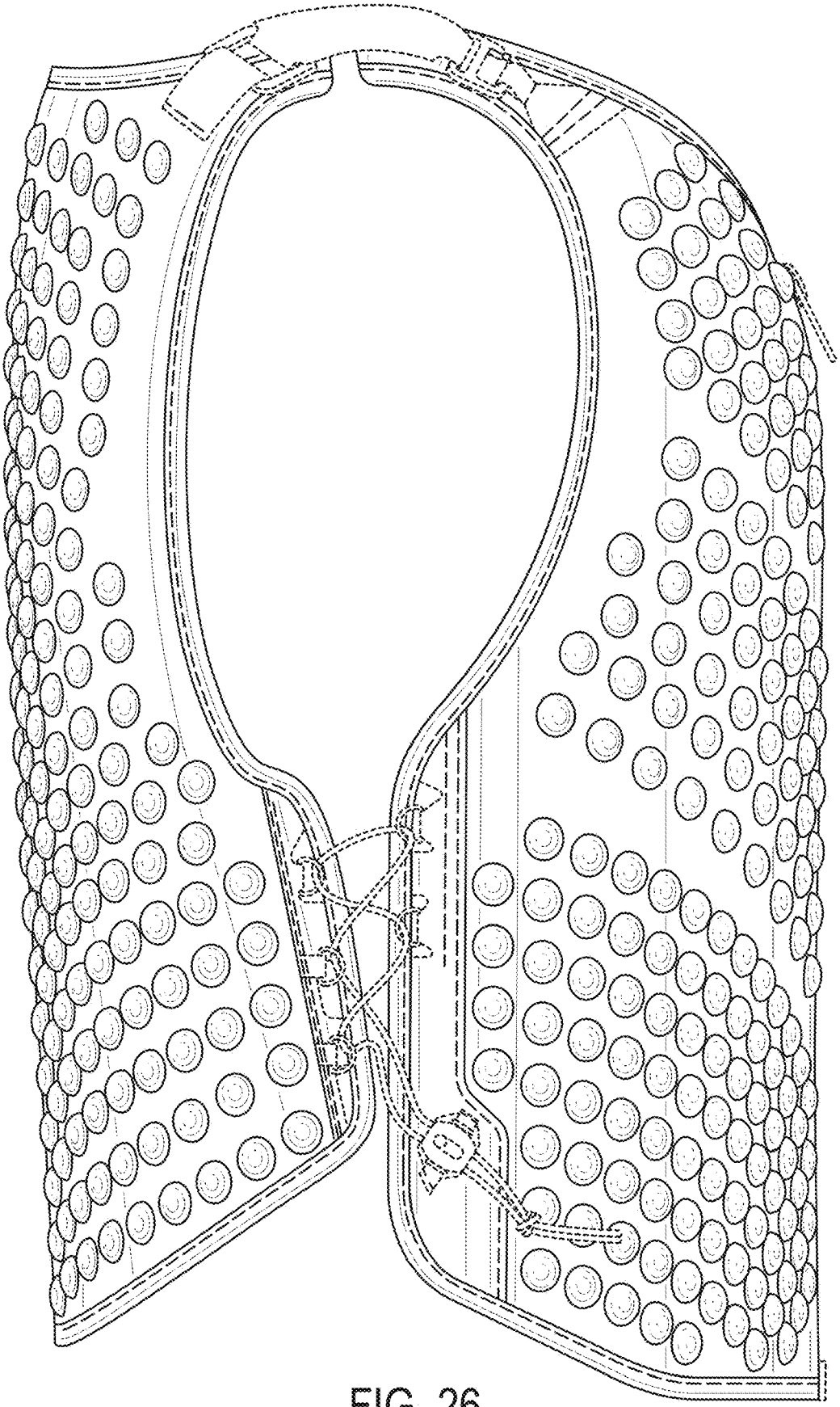
FIG. 26 illustrates a right side view of the weighted apparel article illustrated by FIG. 24.

FIG. 26 illustrates a right side view of the weighted apparel article illustrated by FIG. 24.

Figure 27:
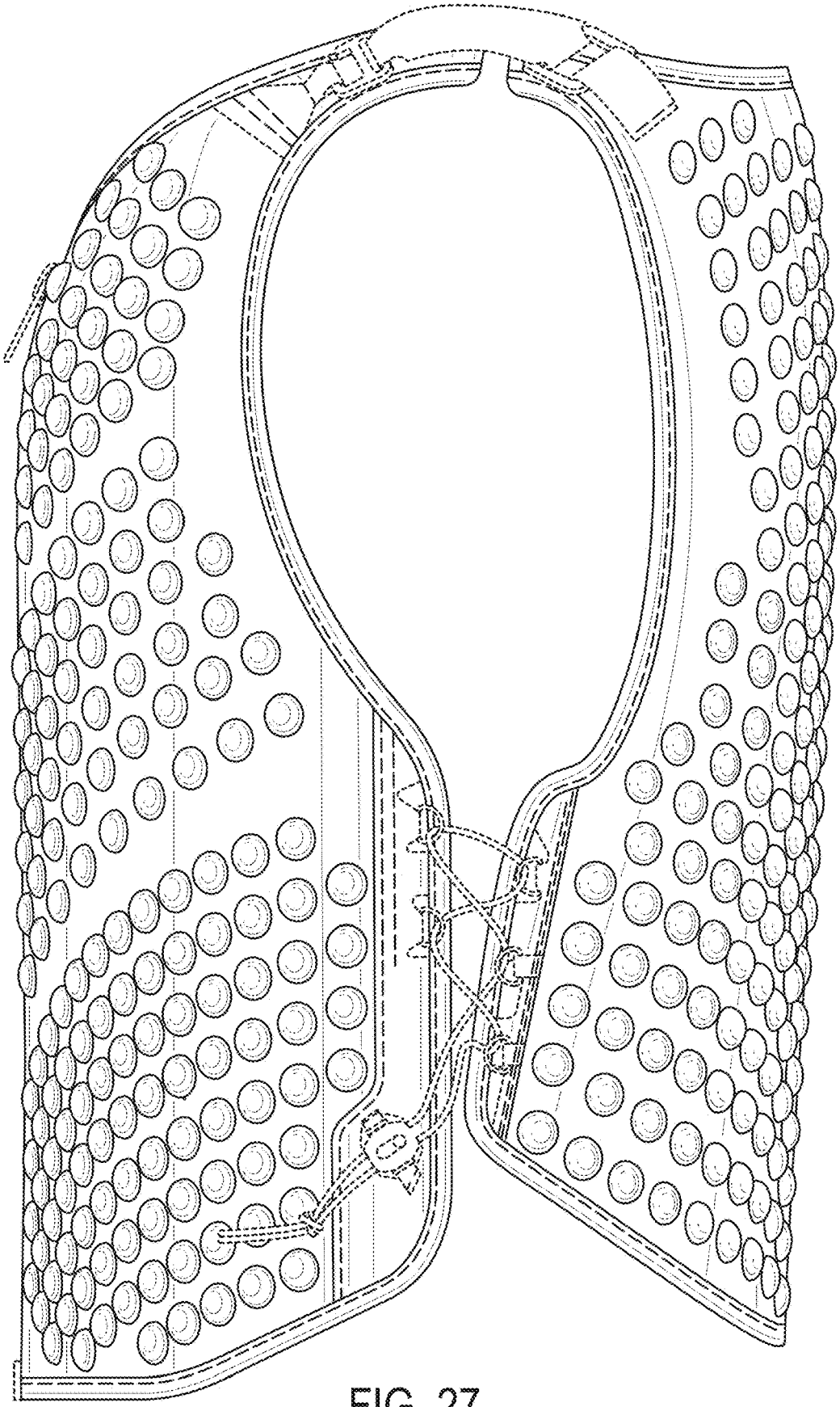
FIG. 27 illustrates a left side view of the weighted apparel article illustrated by FIG. 24.

FIG. 27 illustrates a left side view of the weighted apparel article illustrated by FIG. 24.

Figure 28:
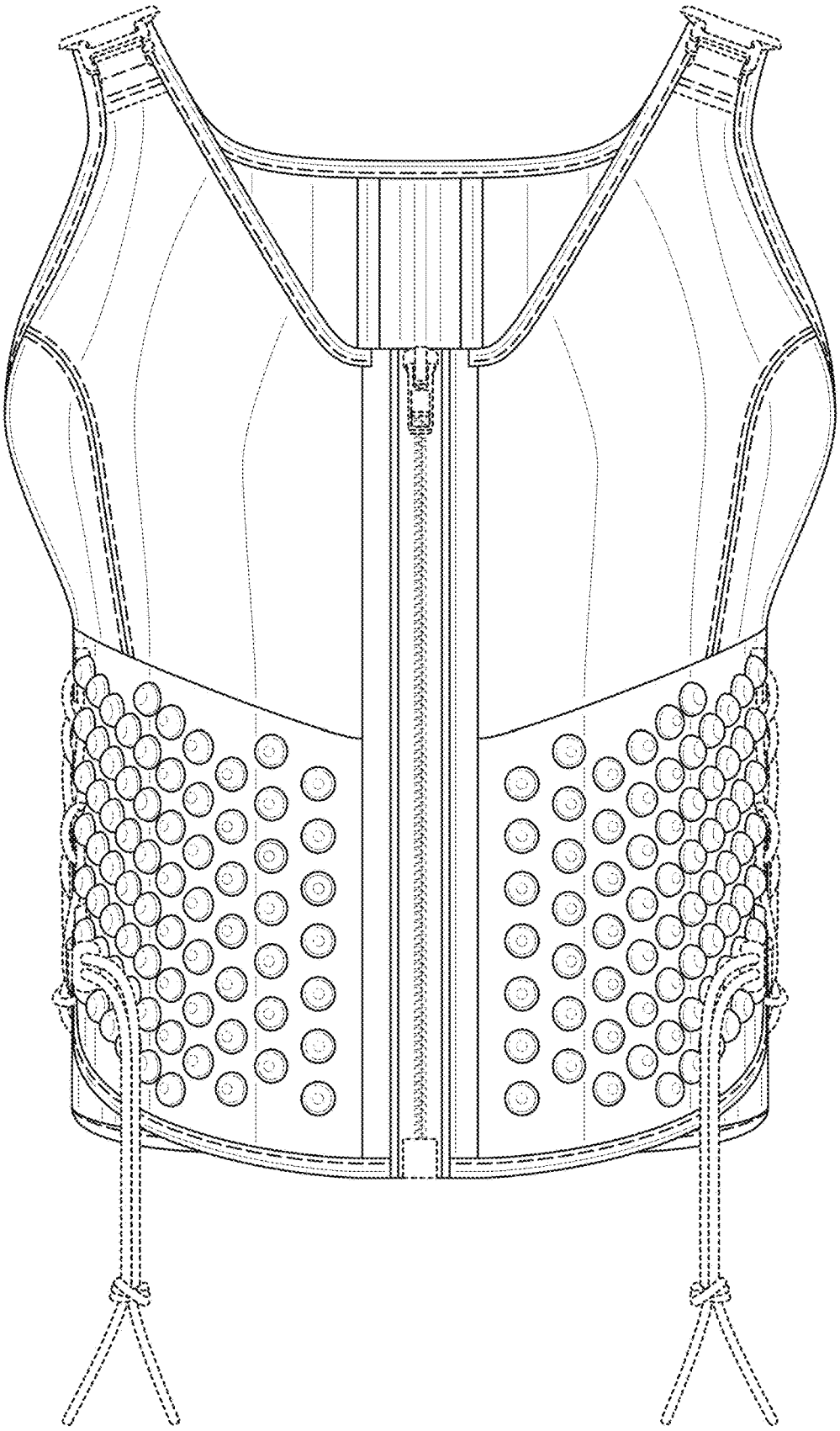
FIG. 28 illustrates a front view of a second example of a weighted apparel article in accordance with certain implementations of the disclosed technology.

FIG. 28 illustrates a front view of a second example of a weighted apparel article in accordance with certain implementations of the disclosed technology.

Figure 29:
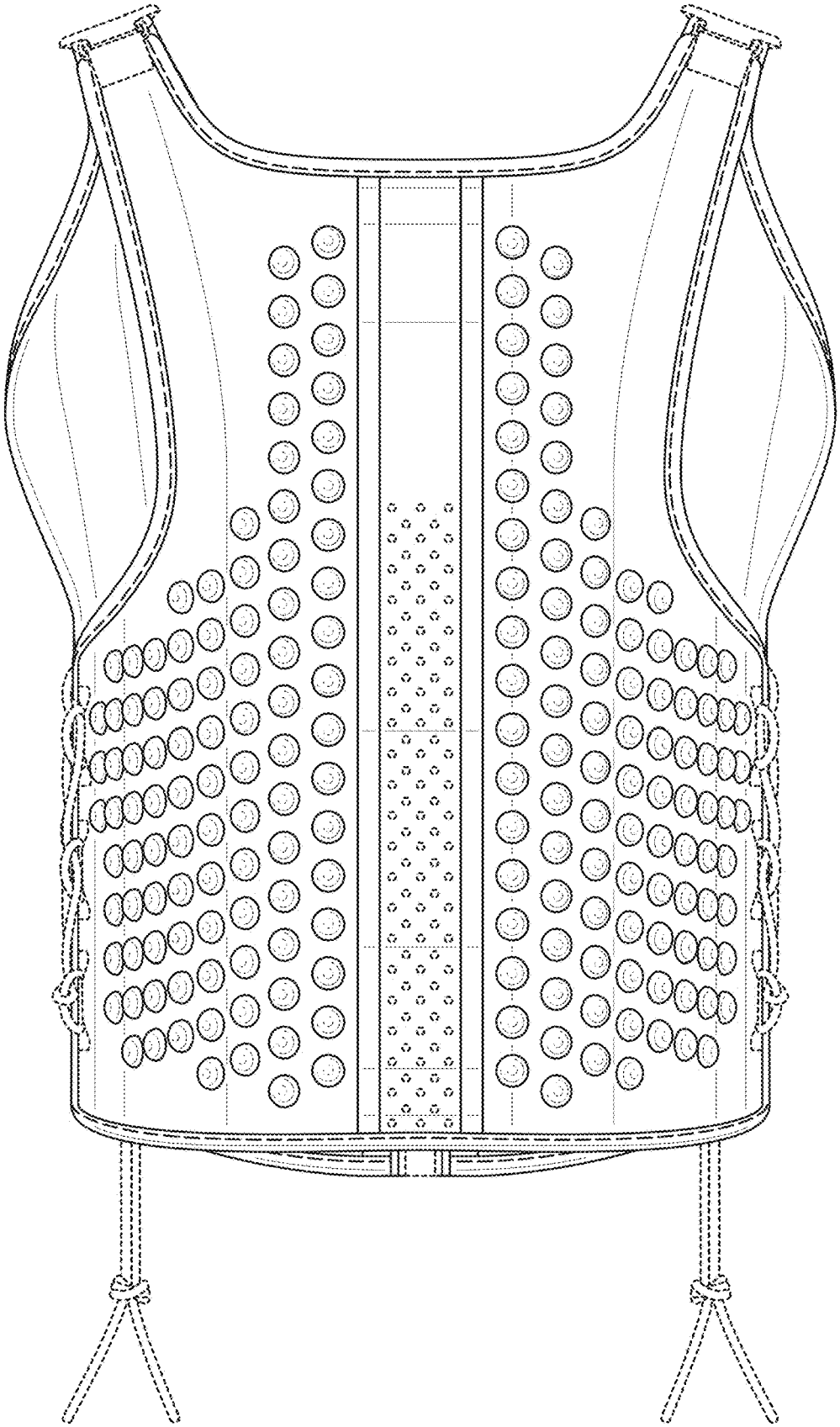
FIG. 29 illustrates a rear view of the weighted apparel article illustrated by FIG. 28.

FIG. 29 illustrates a rear view of the weighted apparel article illustrated by FIG. 28.

Figure 30:
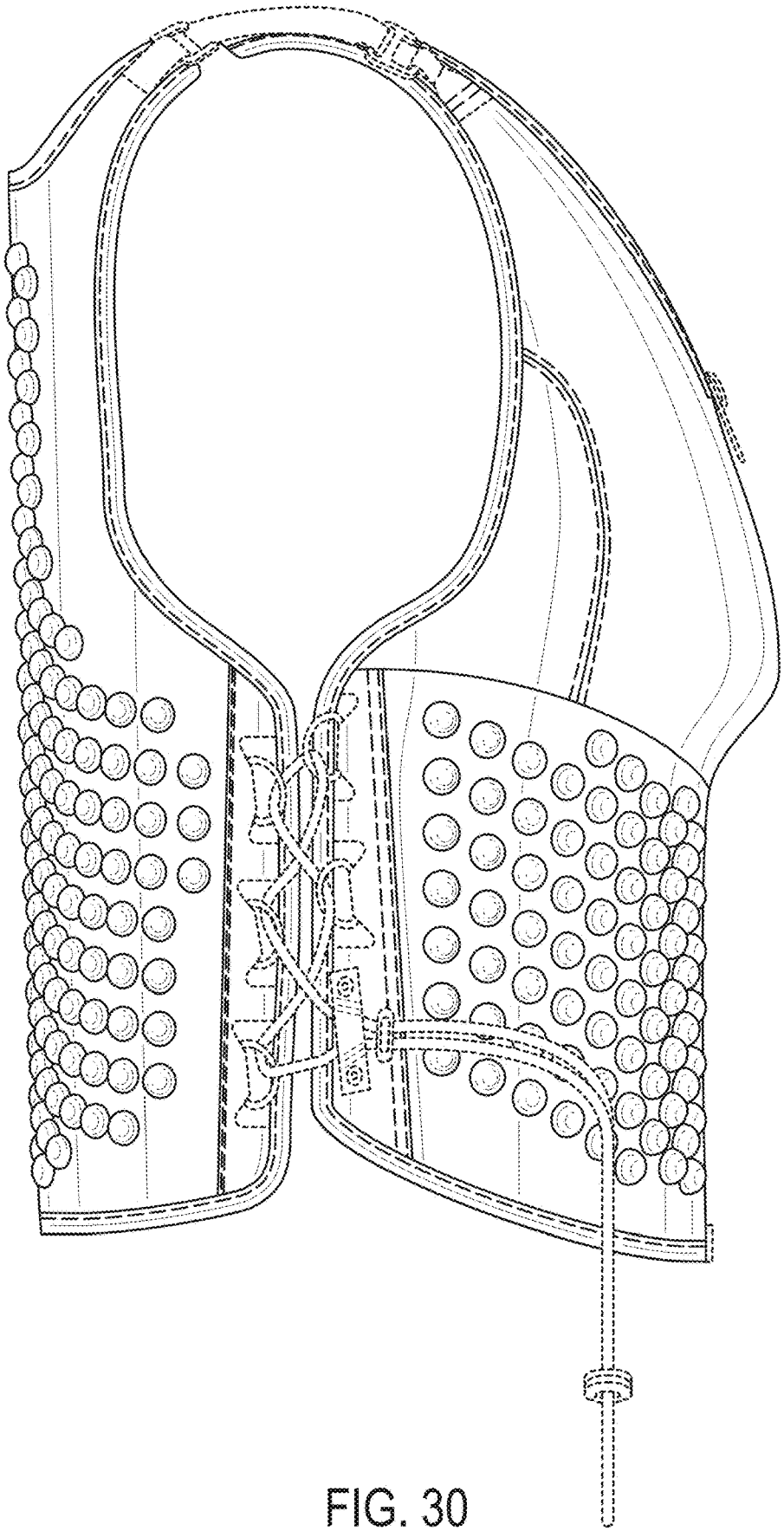
FIG. 30 illustrates a right side view of the weighted apparel article illustrated by FIG. 28.

FIG. 30 illustrates a right side view of the weighted apparel article illustrated by FIG. 28.

Figure 31:
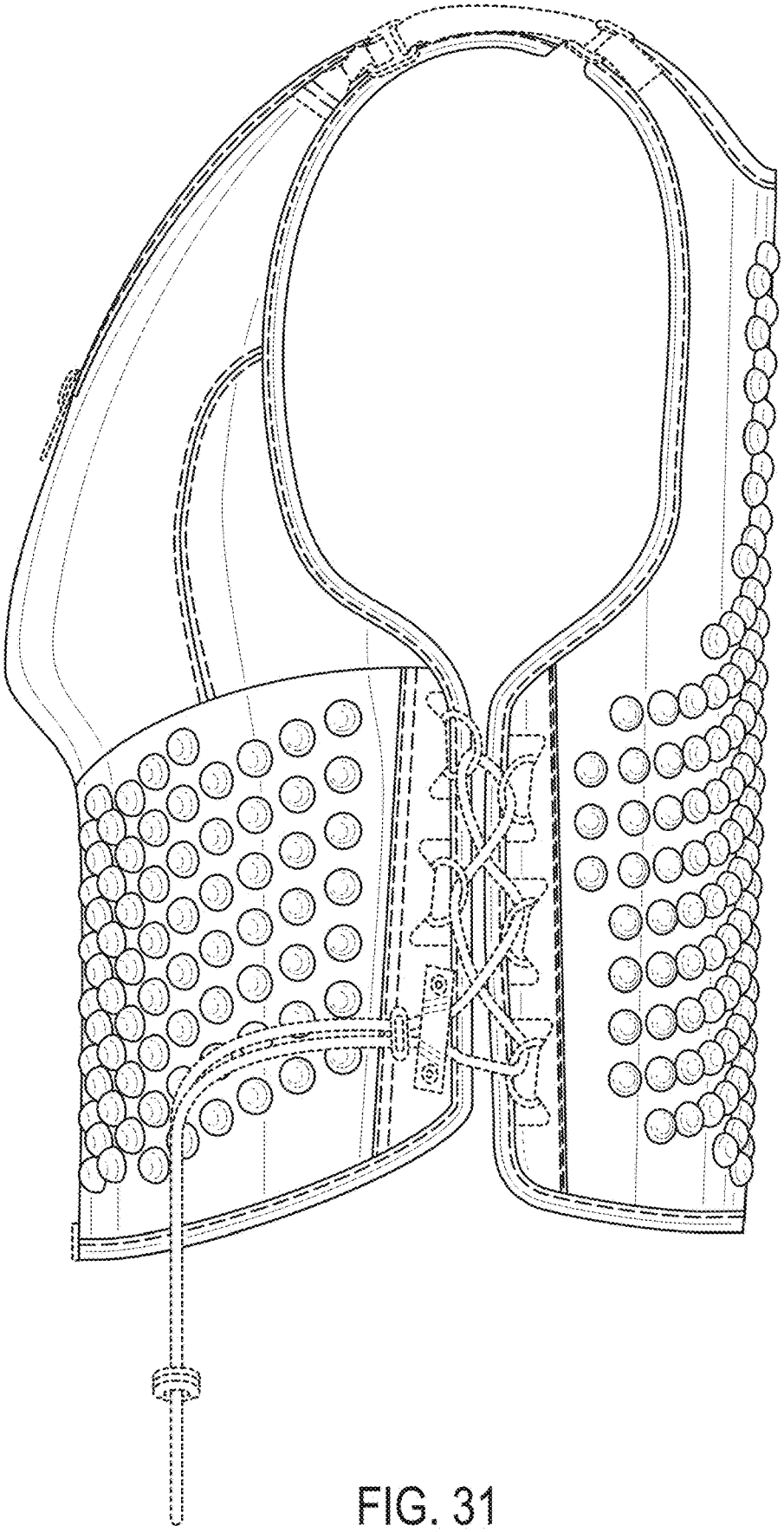
FIG. 31 illustrates a left side view of the weighted apparel article illustrated by FIG. 28.

FIG. 31 illustrates a left side view of the weighted apparel article illustrated by FIG. 28.

Figure 32:
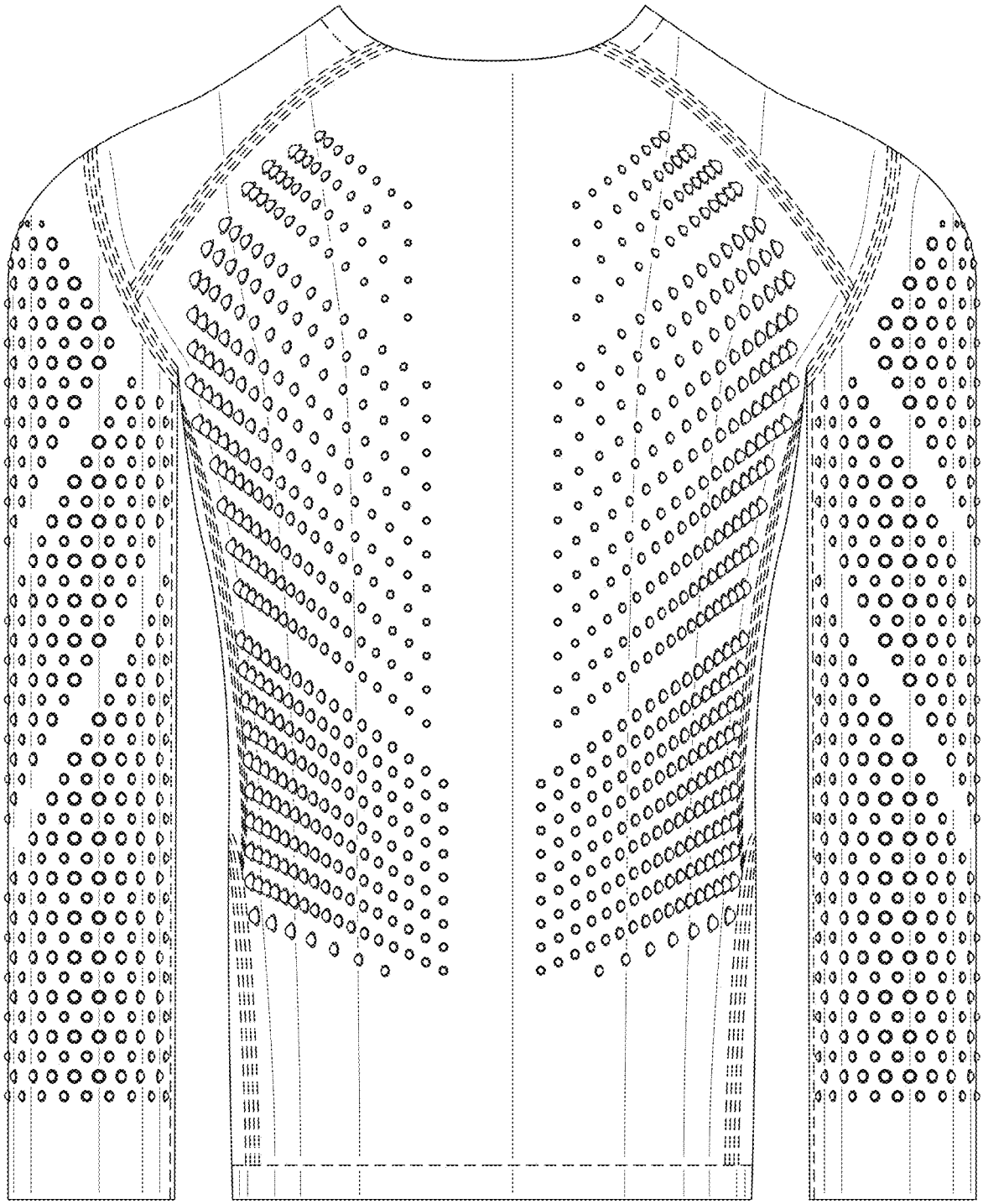
FIG. 32 illustrates a front view of a third example of a weighted apparel article in accordance with certain implementations of the disclosed technology.

FIG. 32 illustrates a front view of a third example of a weighted apparel article in accordance with certain implementations of the disclosed technology.

Figure 33:
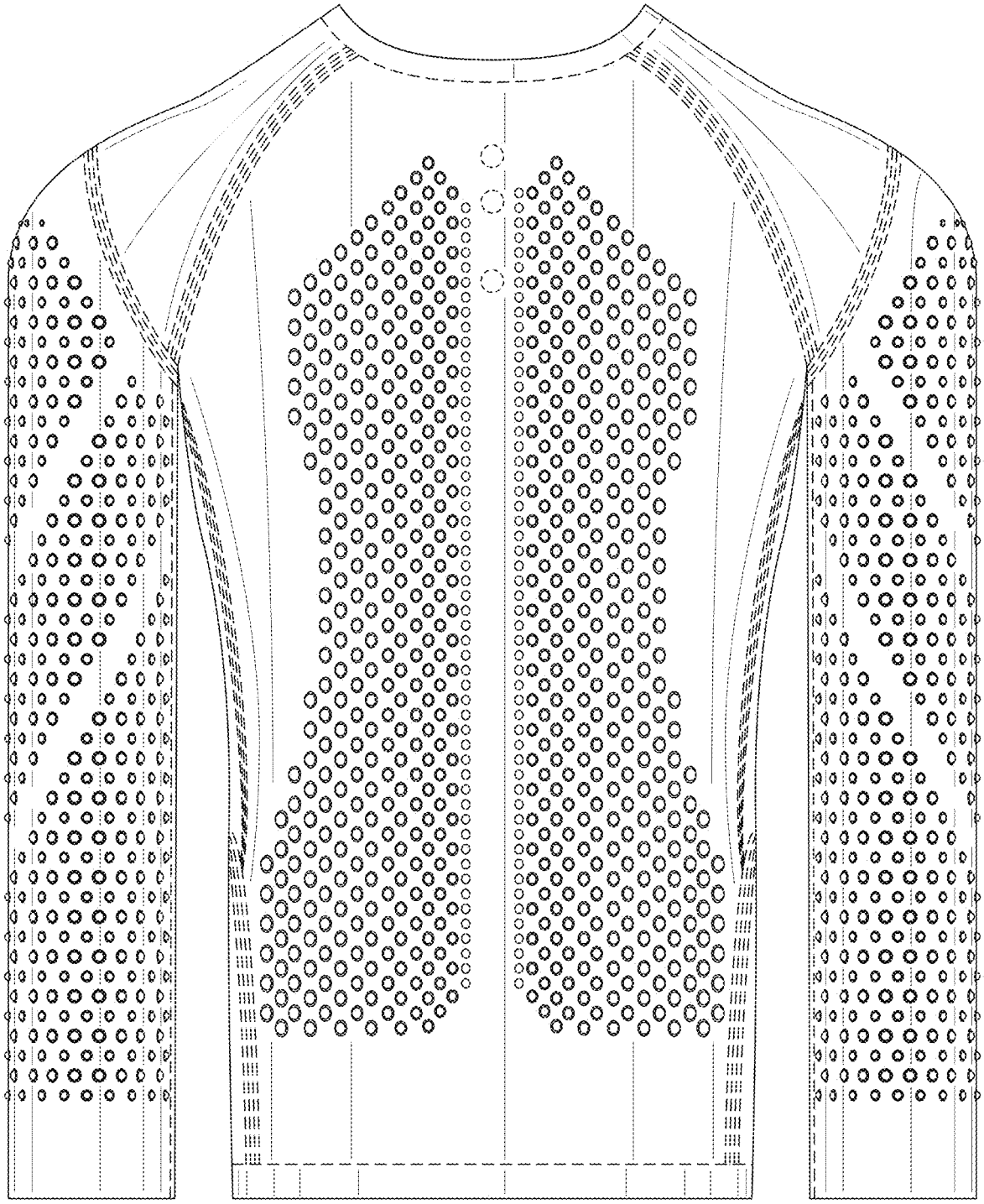
FIG. 33 illustrates a rear view of the weighted apparel article illustrated by FIG. 32.

FIG. 33 illustrates a rear view of the weighted apparel article illustrated by FIG. 32.

Figure 34:
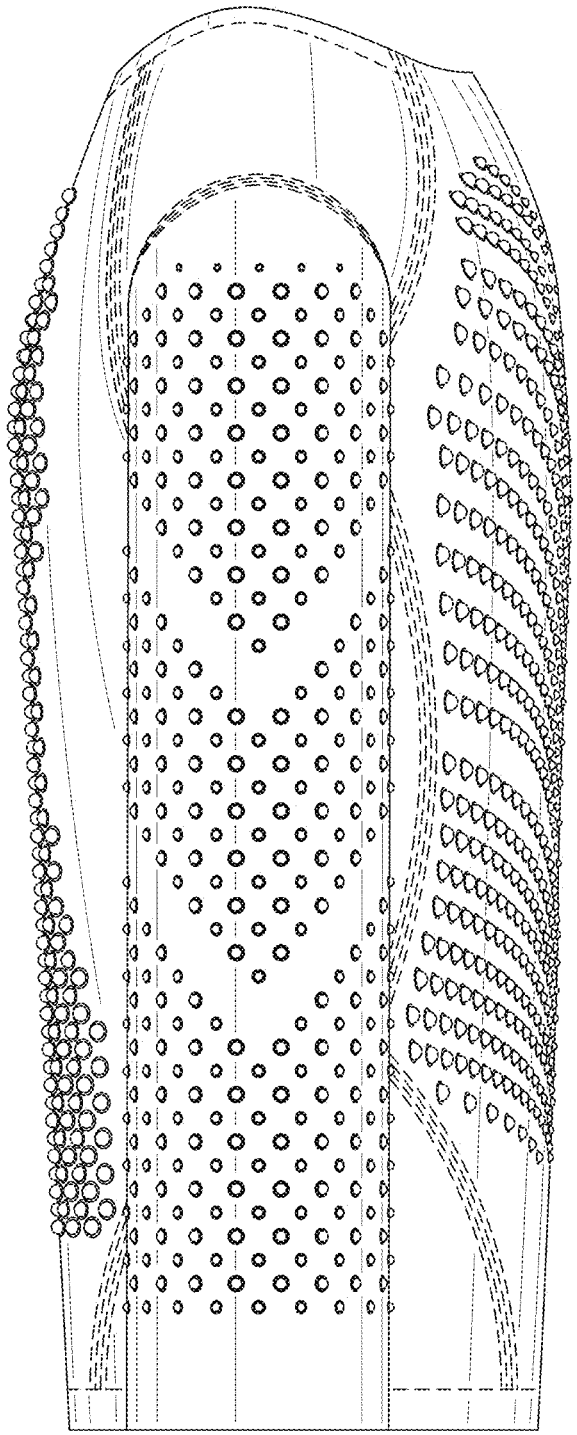
FIG. 34 illustrates a right side view of the weighted apparel article illustrated by FIG. 32.

FIG. 34 illustrates a right side view of the weighted apparel article illustrated by FIG. 32.

Figure 35:
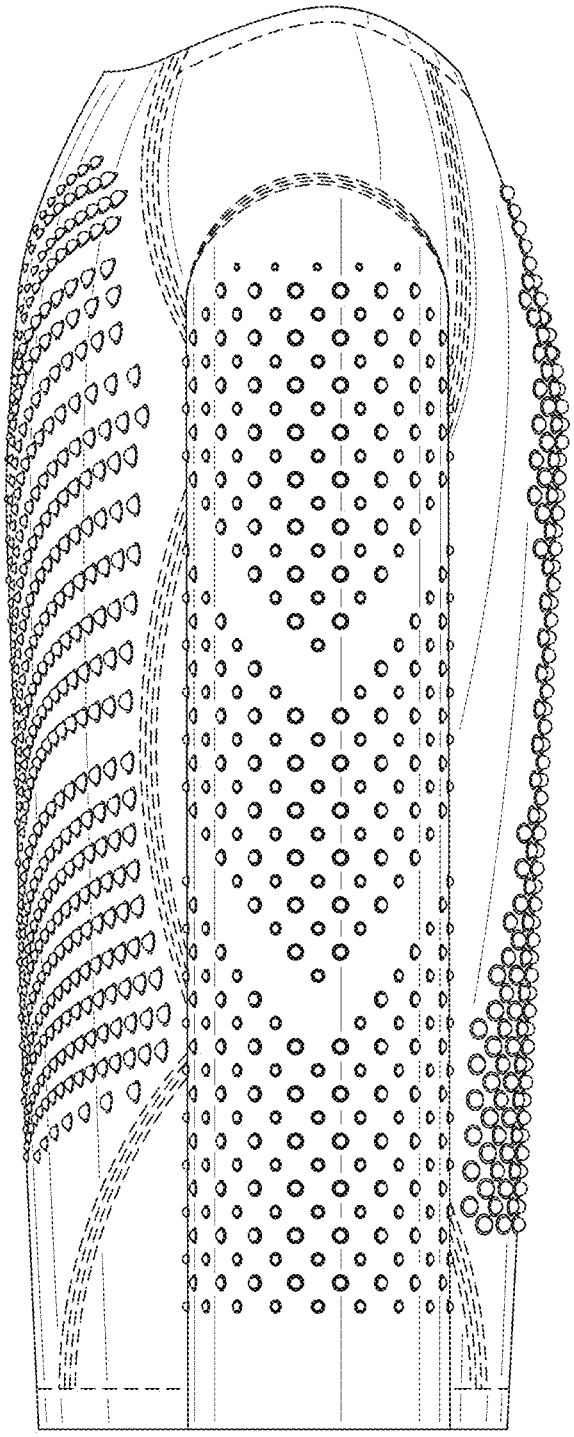
FIG. 35 illustrates a left side view of the weighted apparel article illustrated by FIG. 32.

FIG. 35 illustrates a left side view of the weighted apparel article illustrated by FIG. 32.

Figure 36:
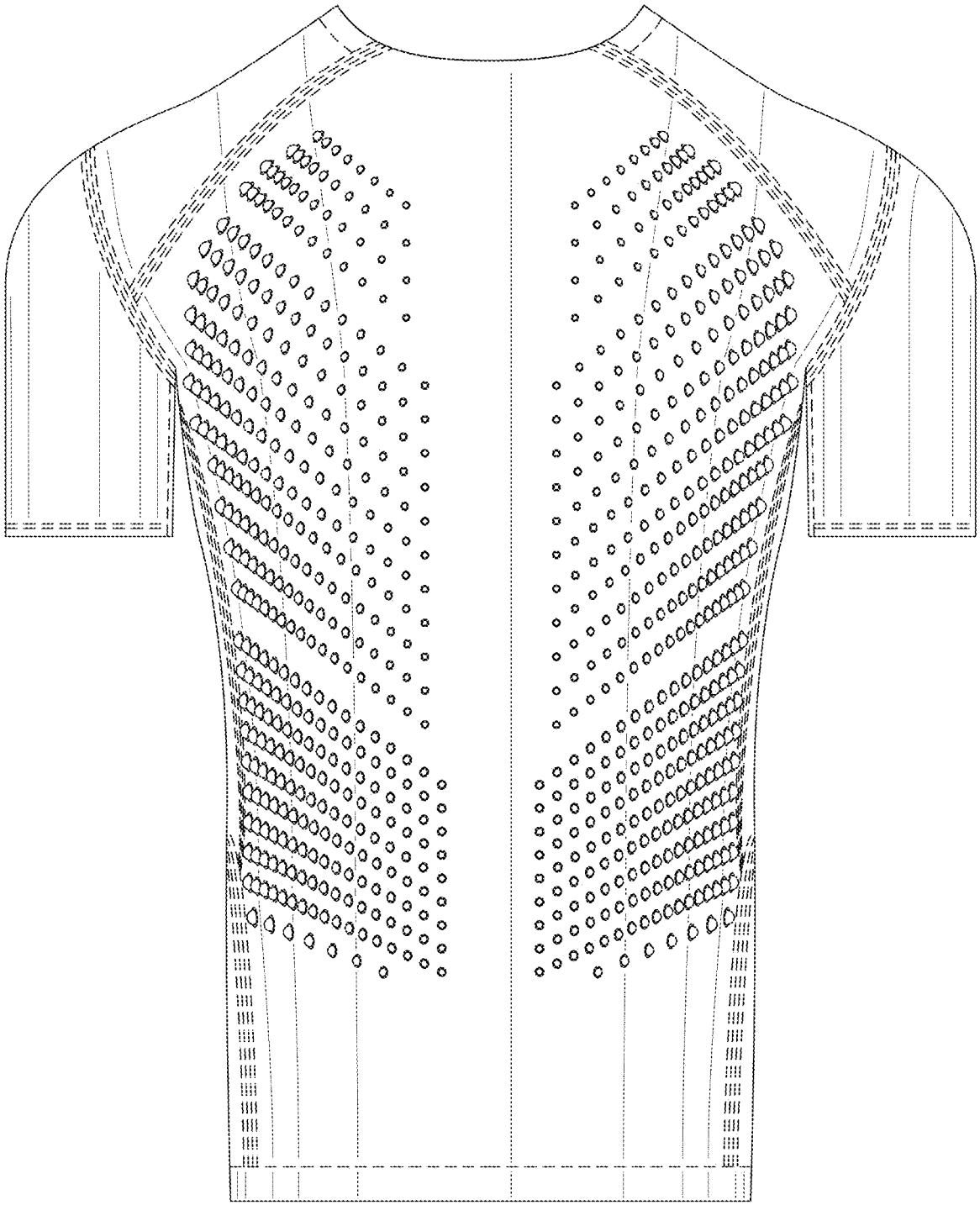
FIG. 36 illustrates a front view of a fourth example of a weighted apparel article in accordance with certain implementations of the disclosed technology.

FIG. 36 illustrates a front view of a fourth example of a weighted apparel article in accordance with certain implementations of the disclosed technology.

Figure 37:
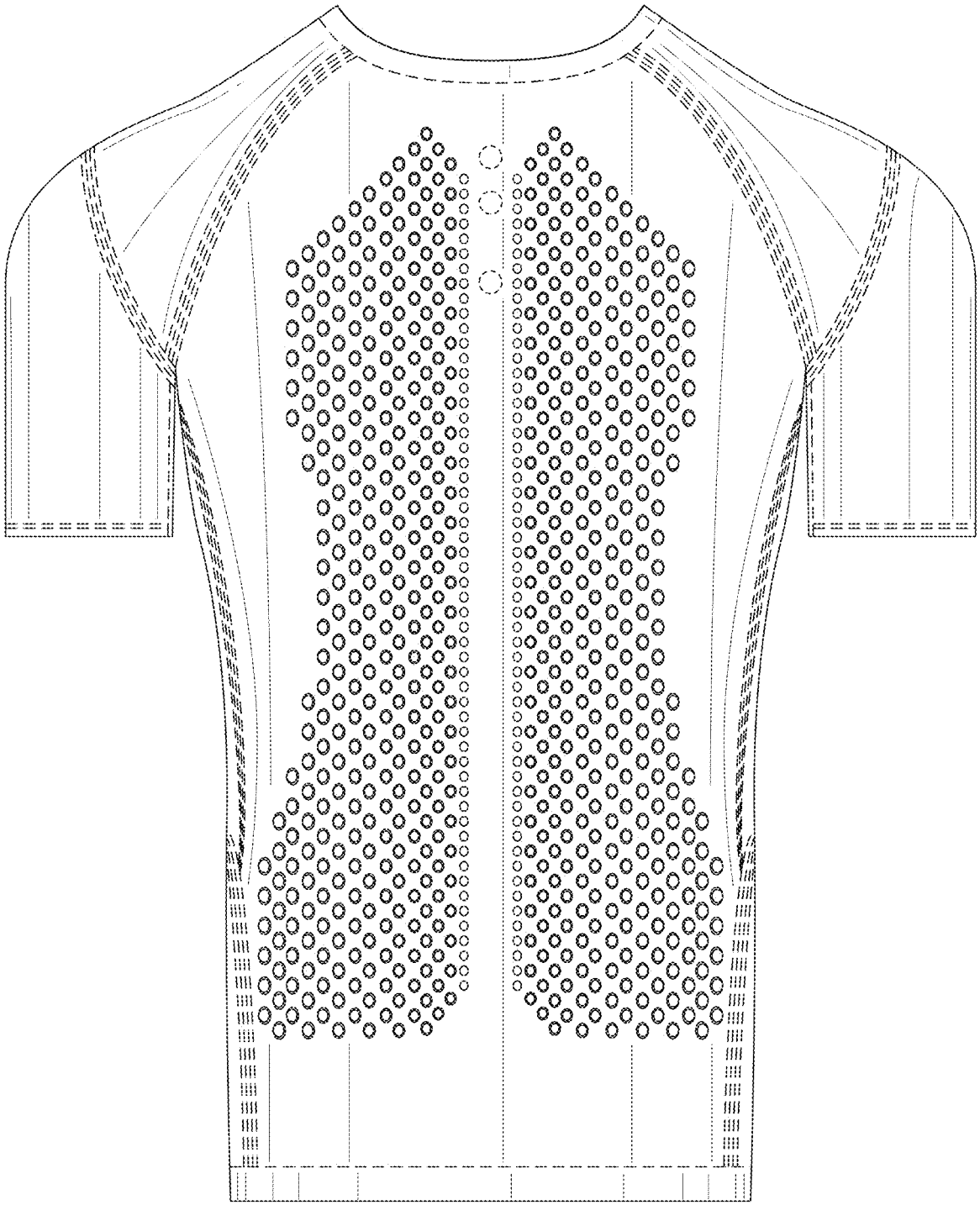
FIG. 37 illustrates a rear view of the weighted apparel article illustrated by FIG. 36.

FIG. 37 illustrates a rear view of the weighted apparel article illustrated by FIG. 36.

Figure 38:
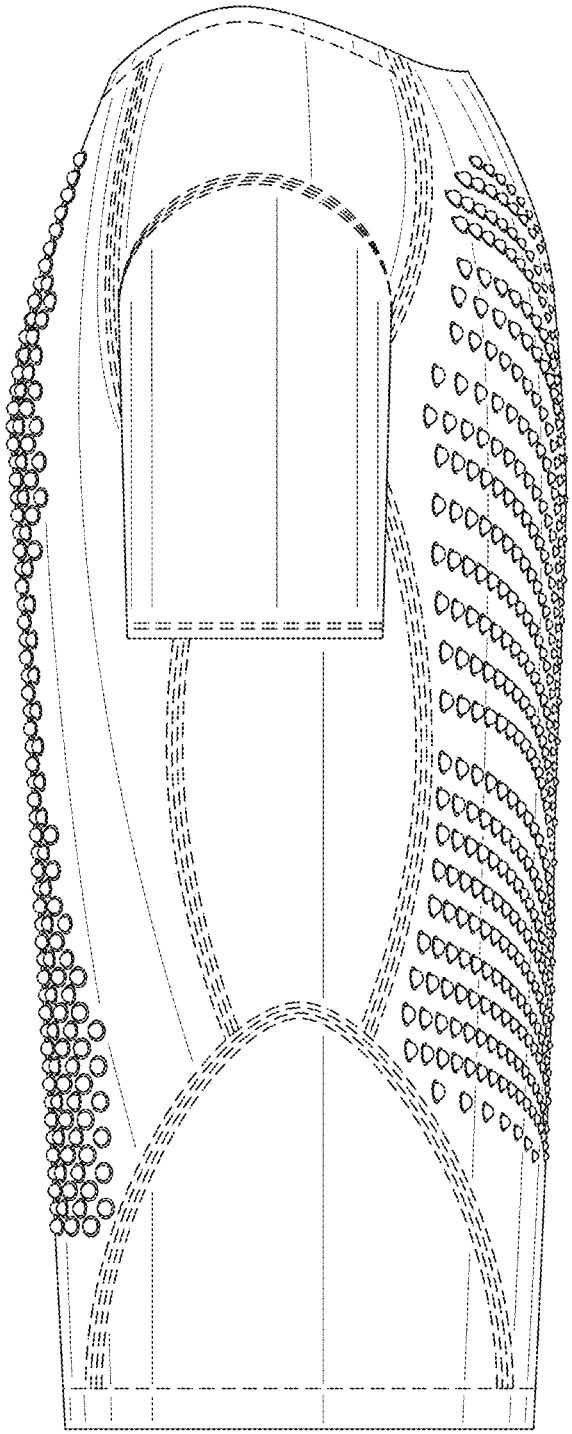
FIG. 38 illustrates a right side view of the weighted apparel article illustrated by FIG. 32.

FIG. 38 illustrates a right side view of the weighted apparel article illustrated by FIG. 32.

Figure 39:
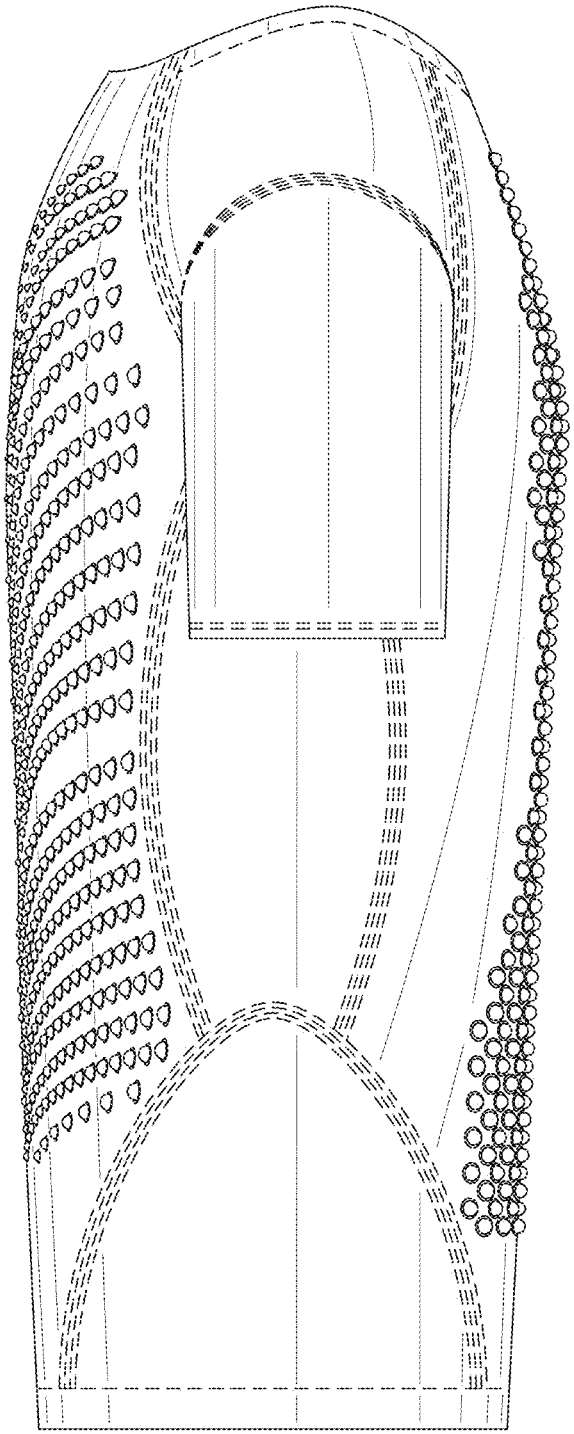
FIG. 39 illustrates a left side view of the weighted apparel article illustrated by FIG. 36.

FIG. 39 illustrates a left side view of the weighted apparel article illustrated by FIG. 36.

Figure 40:
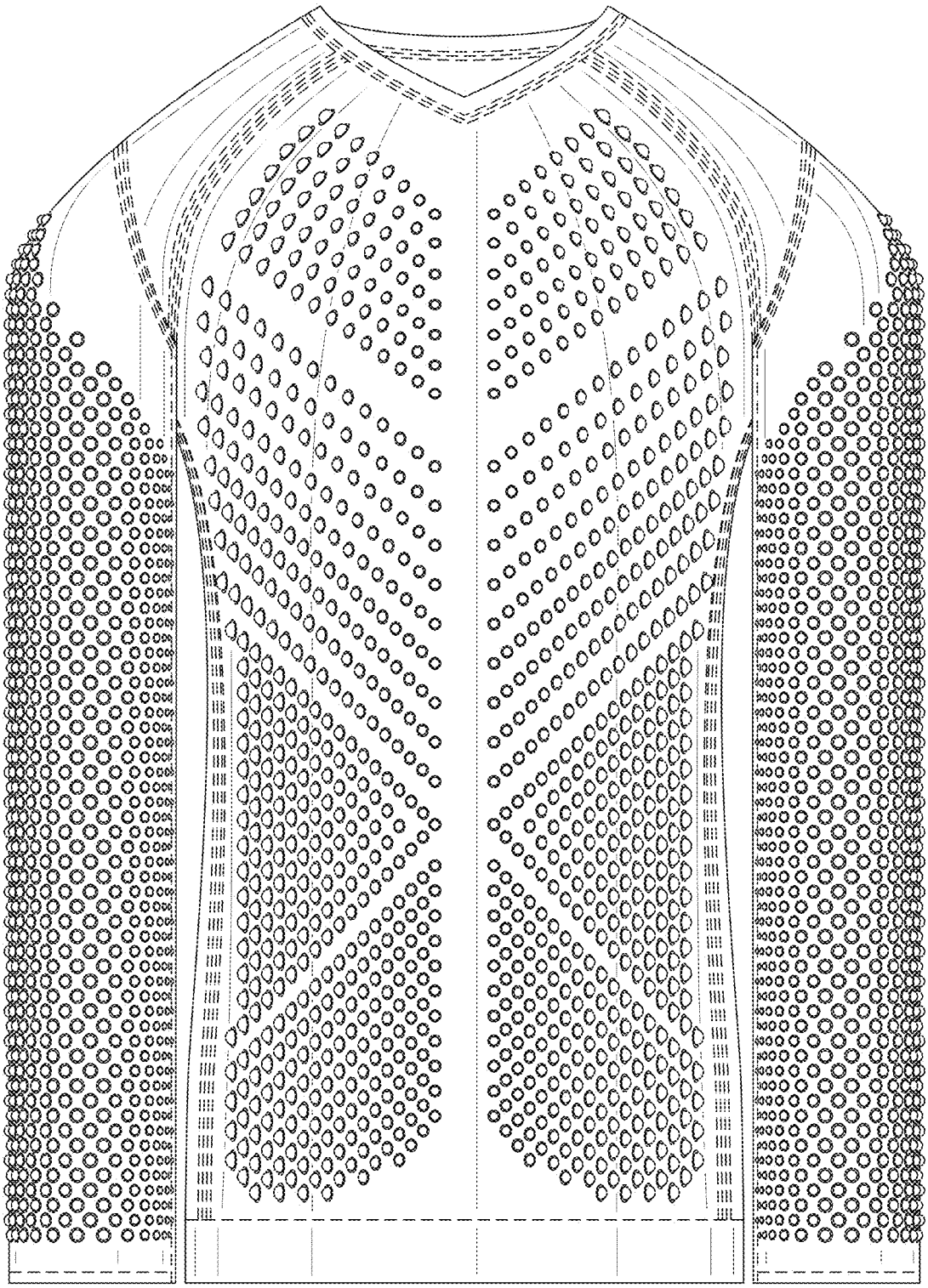
FIG. 40 illustrates a front view of a fifth example of a weighted apparel article in accordance with certain implementations of the disclosed technology.

FIG. 40 illustrates a front view of a fifth example of a weighted apparel article in accordance with certain implementations of the disclosed technology.

Figure 41:
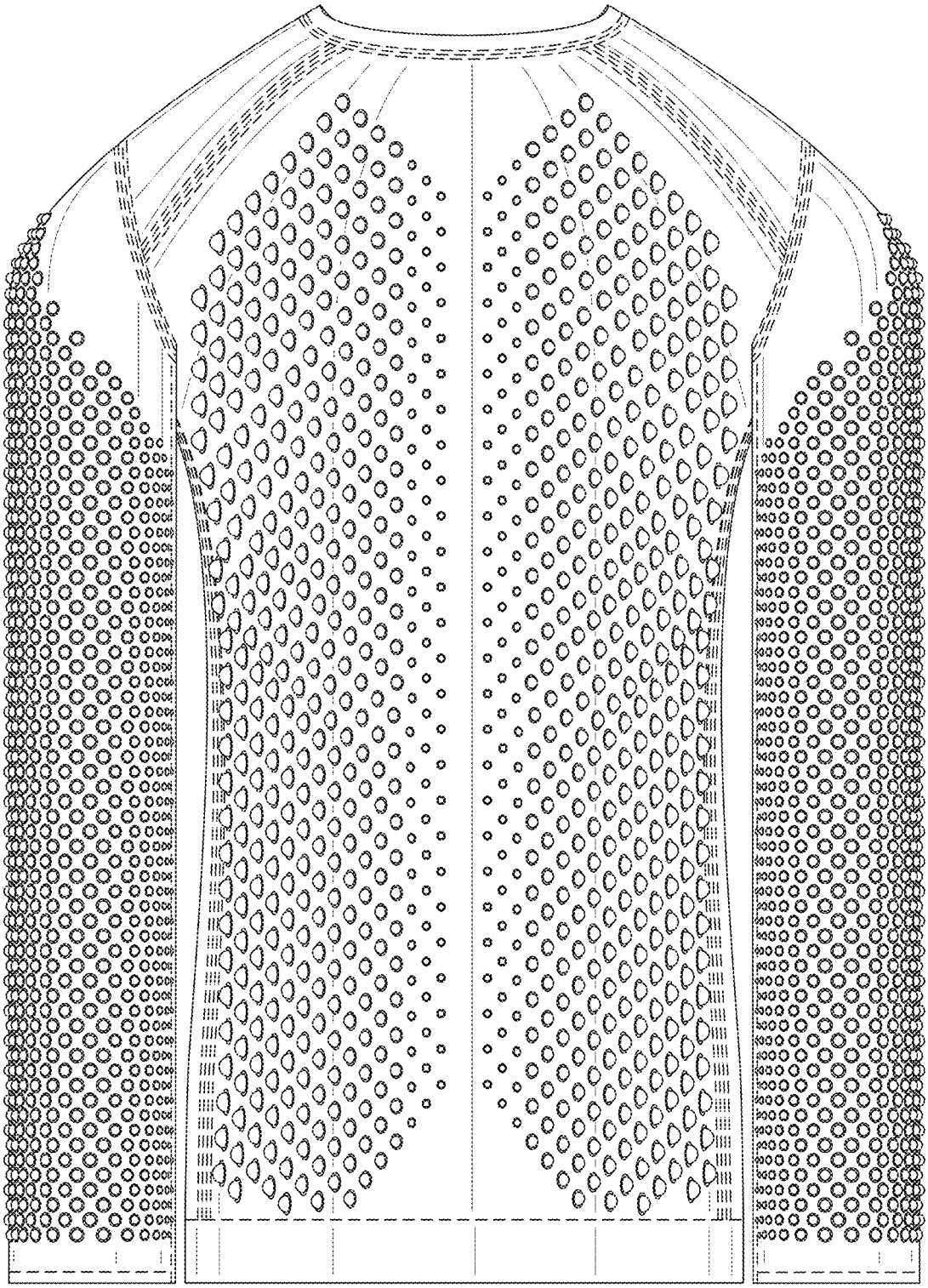
FIG. 41 illustrates a rear view of the weighted apparel article illustrated by FIG. 40.

FIG. 41 illustrates a rear view of the weighted apparel article illustrated by FIG. 40.

Figure 42:
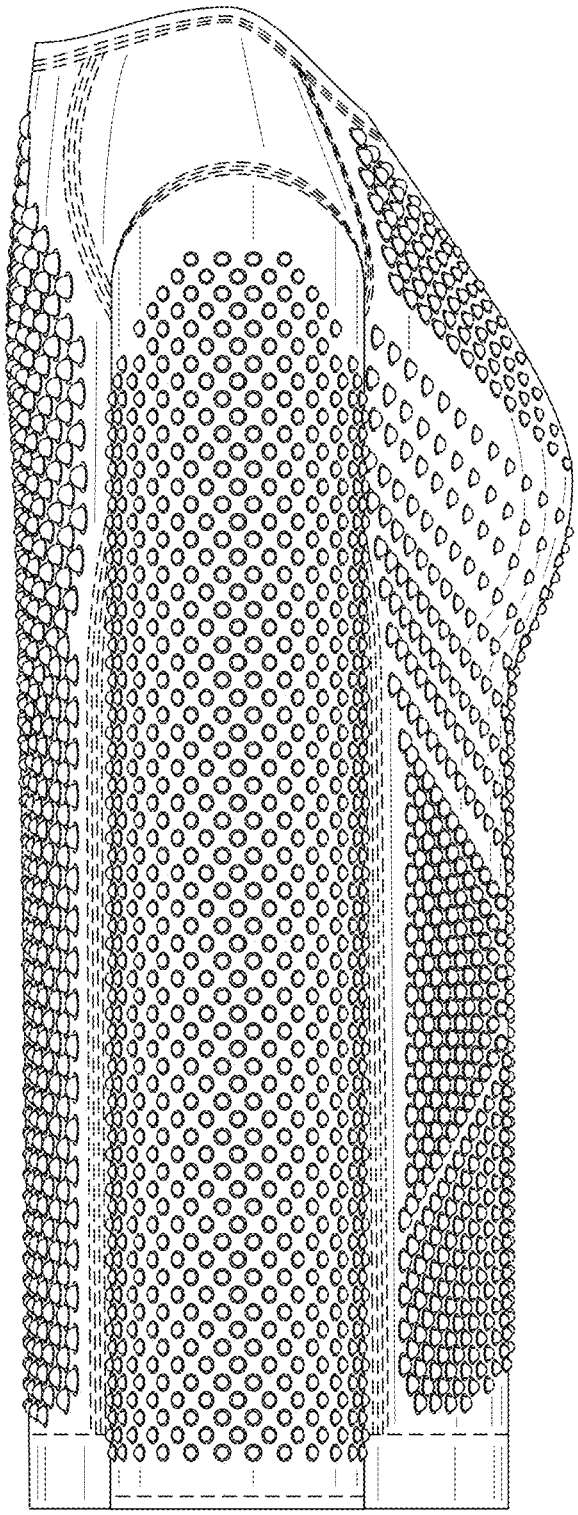
FIG. 42 illustrates a right side view of the weighted apparel article illustrated by FIG. 40.

FIG. 42 illustrates a right side view of the weighted apparel article illustrated by FIG. 40.

Figure 43:
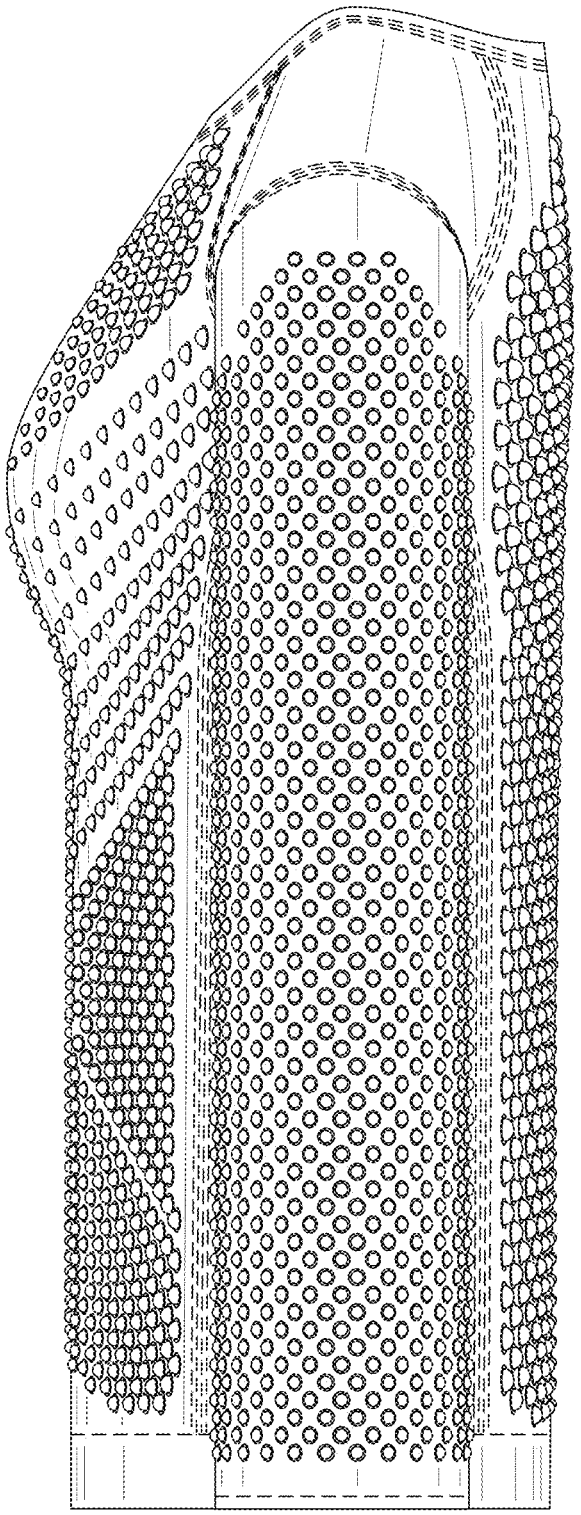
FIG. 43 illustrates a left side view of the weighted apparel article illustrated by FIG. 40.

FIG. 43 illustrates a left side view of the weighted apparel article illustrated by FIG. 40.

Figure 44:
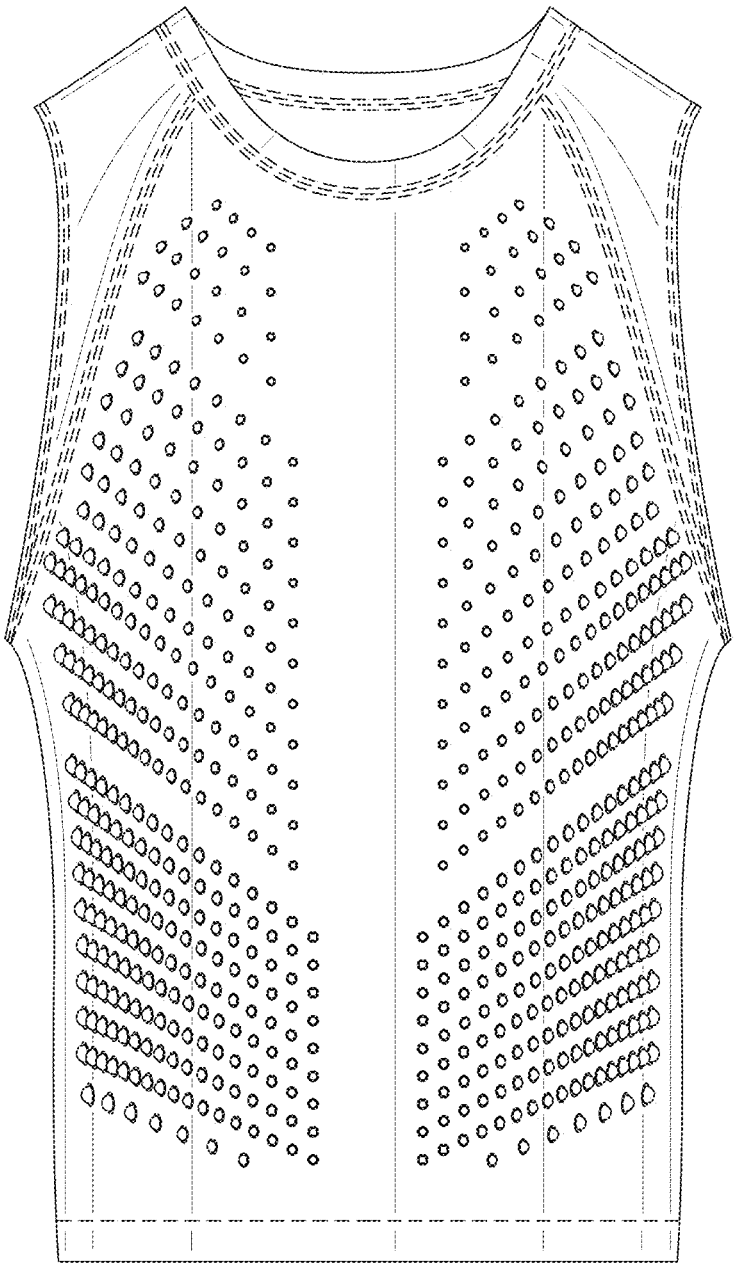
FIG. 44 illustrates a front view of a sixth example of a weighted apparel article in accordance with certain implementations of the disclosed technology.

FIG. 44 illustrates a front view of a sixth example of a weighted apparel article in accordance with certain implementations of the disclosed technology.

Figure 45:
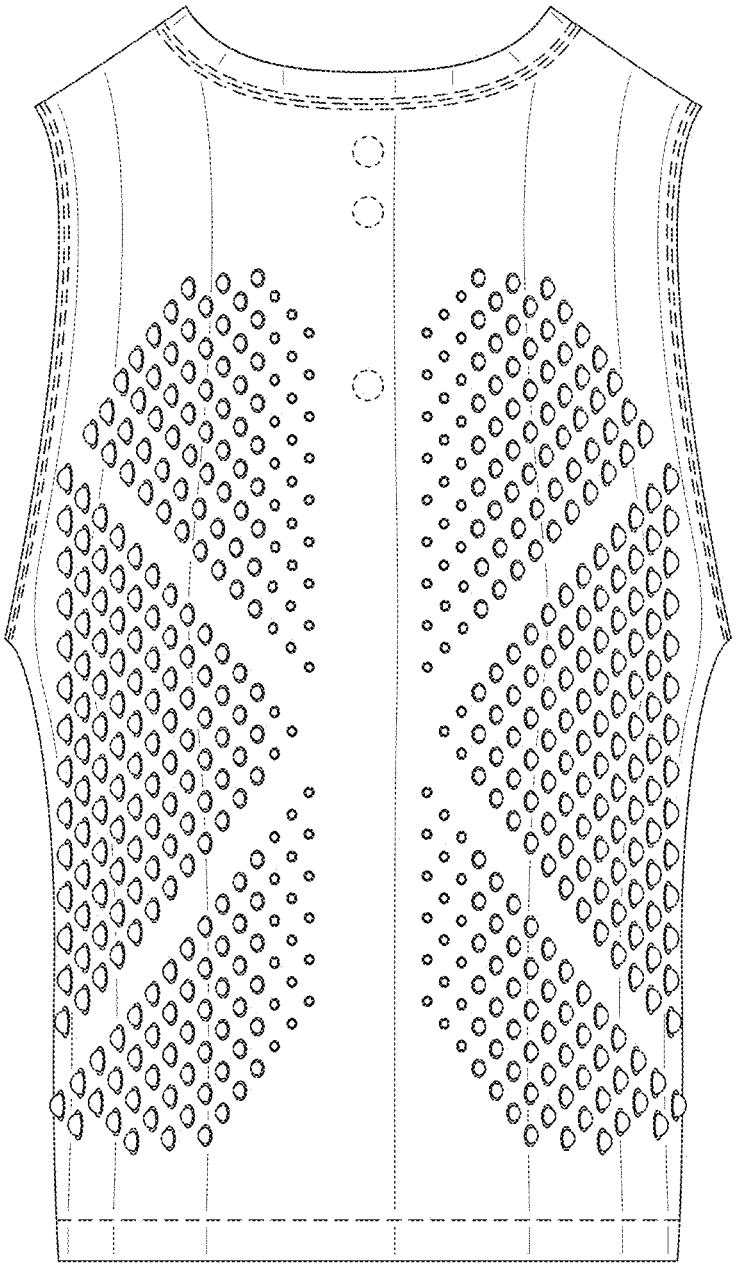
FIG. 45 illustrates a rear view of the weighted apparel article illustrated by FIG. 44.

FIG. 45 illustrates a rear view of the weighted apparel article illustrated by FIG. 44.

Figure 46:
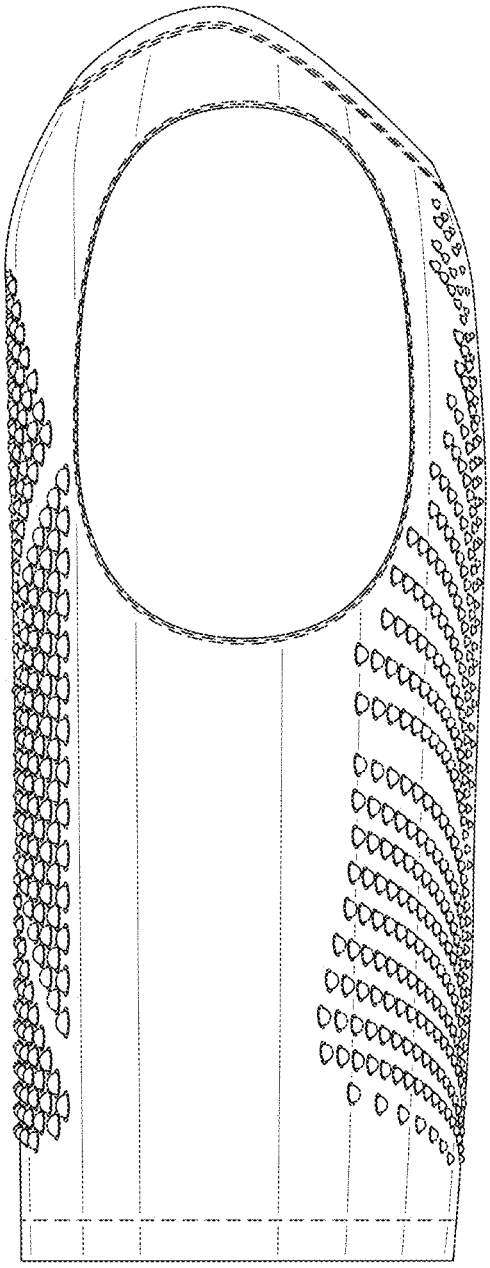
FIG. 46 illustrates a right side view of the weighted apparel article illustrated by FIG. 44.

FIG. 46 illustrates a right side view of the weighted apparel article illustrated by FIG. 44.

Figure 47:
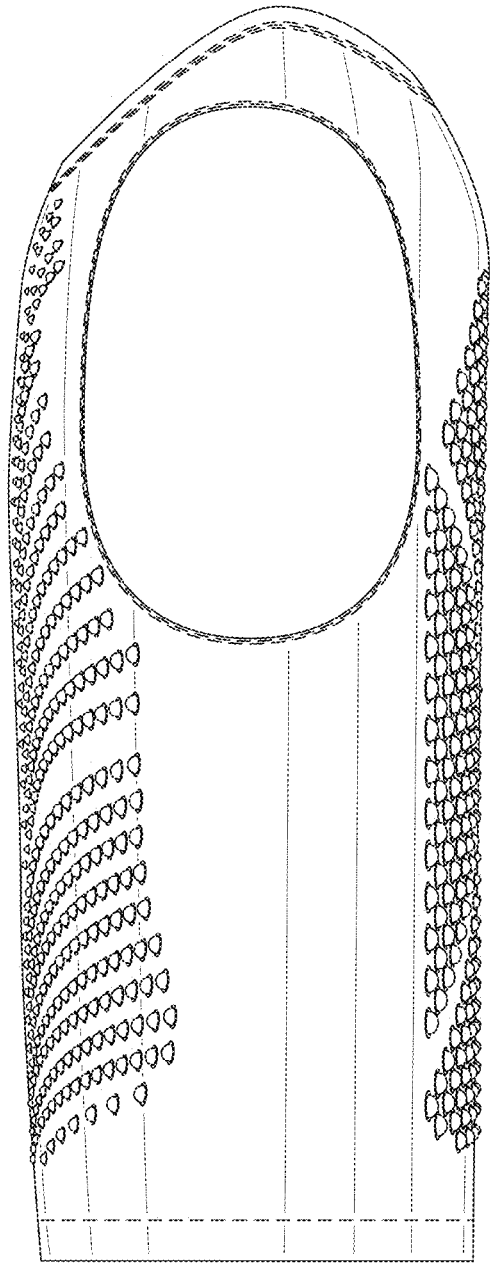
FIG. 47 illustrates a left side view of the weighted apparel article illustrated by FIG. 44.

FIG. 47 illustrates a left side view of the weighted apparel article illustrated by FIG. 44.

Figure 48:
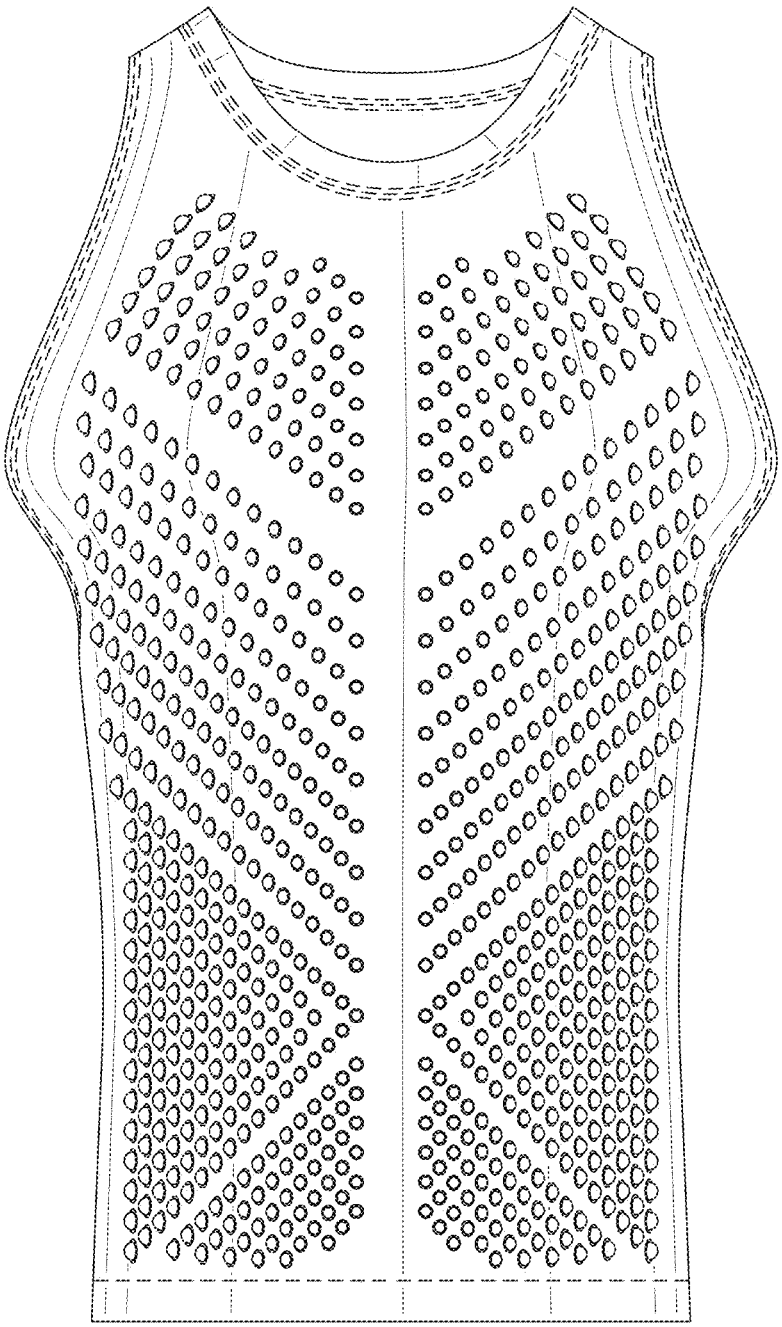
FIG. 48 illustrates a front view of a seventh example of a weighted apparel article in accordance with certain implementations of the disclosed technology.

FIG. 48 illustrates a front view of a seventh example of a weighted apparel article in accordance with certain implementations of the disclosed technology.

Figure 49:
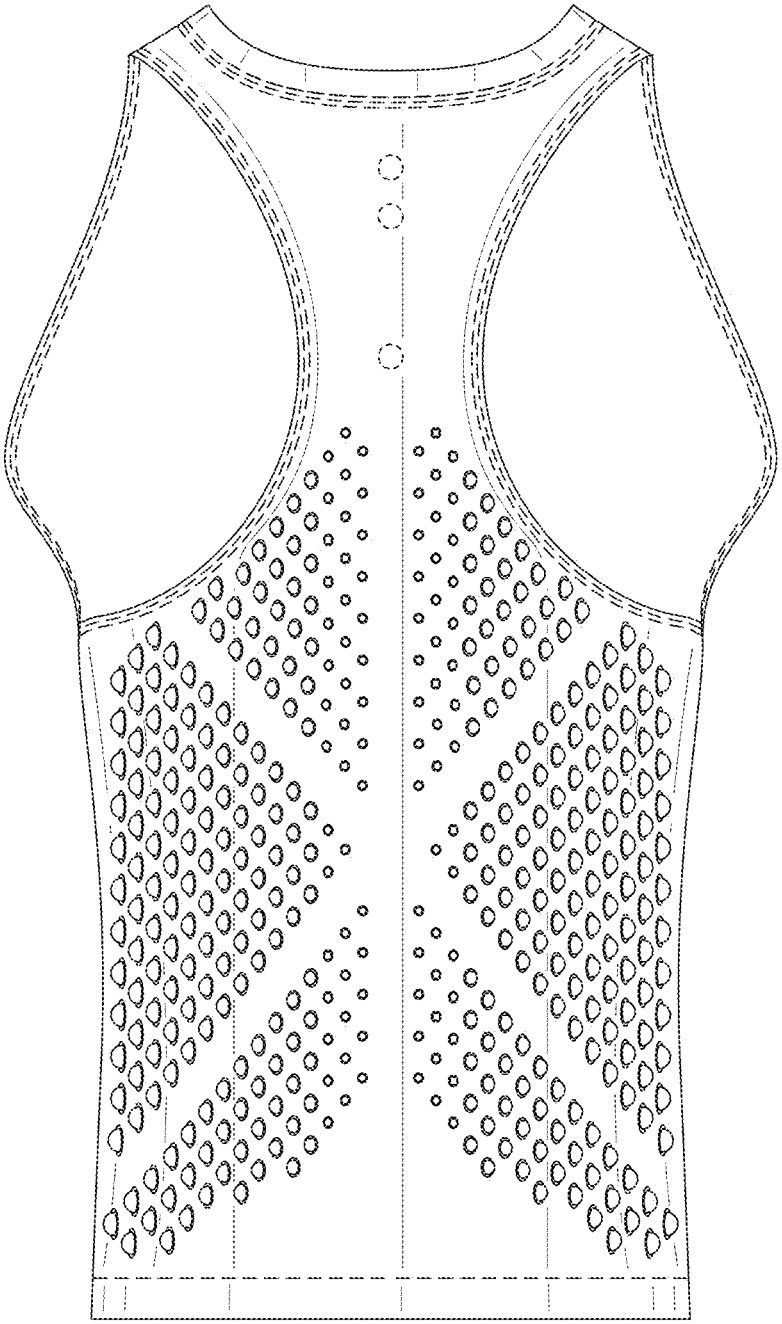
FIG. 49 illustrates a rear view of the weighted apparel article illustrated by FIG. 48.

FIG. 49 illustrates a rear view of the weighted apparel article illustrated by FIG. 48.

Figure 50:
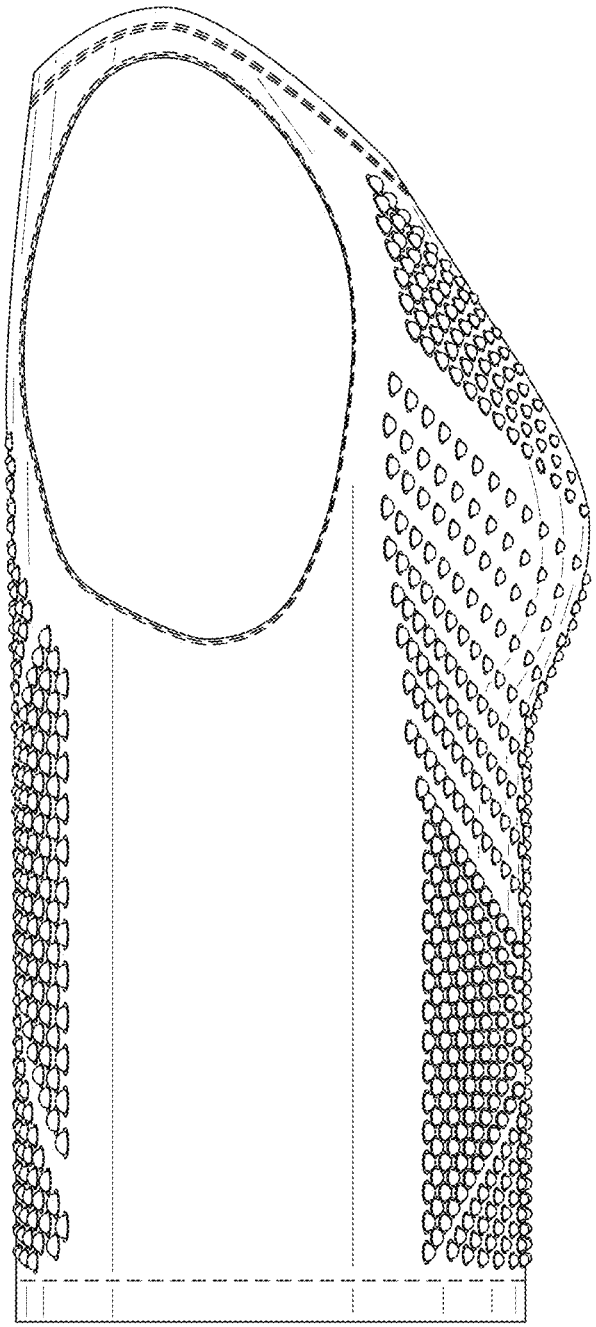
FIG. 50 illustrates a right side view of the weighted apparel article illustrated by FIG. 48.

FIG. 50 illustrates a right side view of the weighted apparel article illustrated by FIG. 48.

Figure 51:
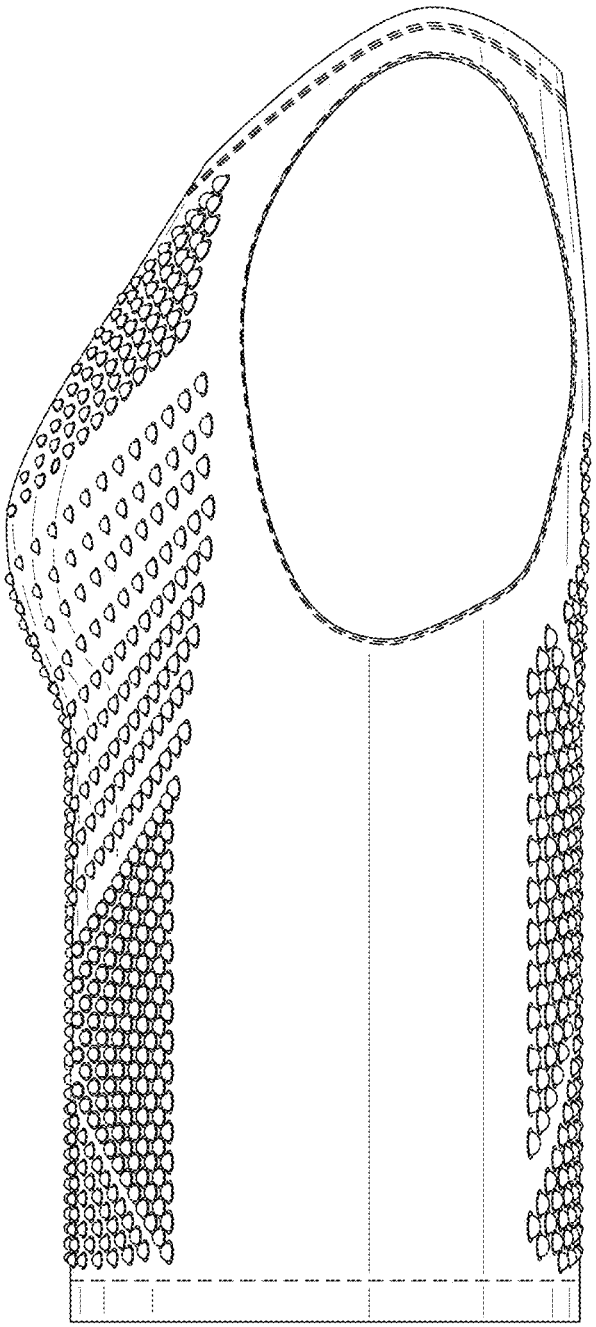
FIG. 51 illustrates a left side view of the weighted apparel article illustrated by FIG. 48.

FIG. 51 illustrates a left side view of the weighted apparel article illustrated by FIG. 48.

Figure 52:
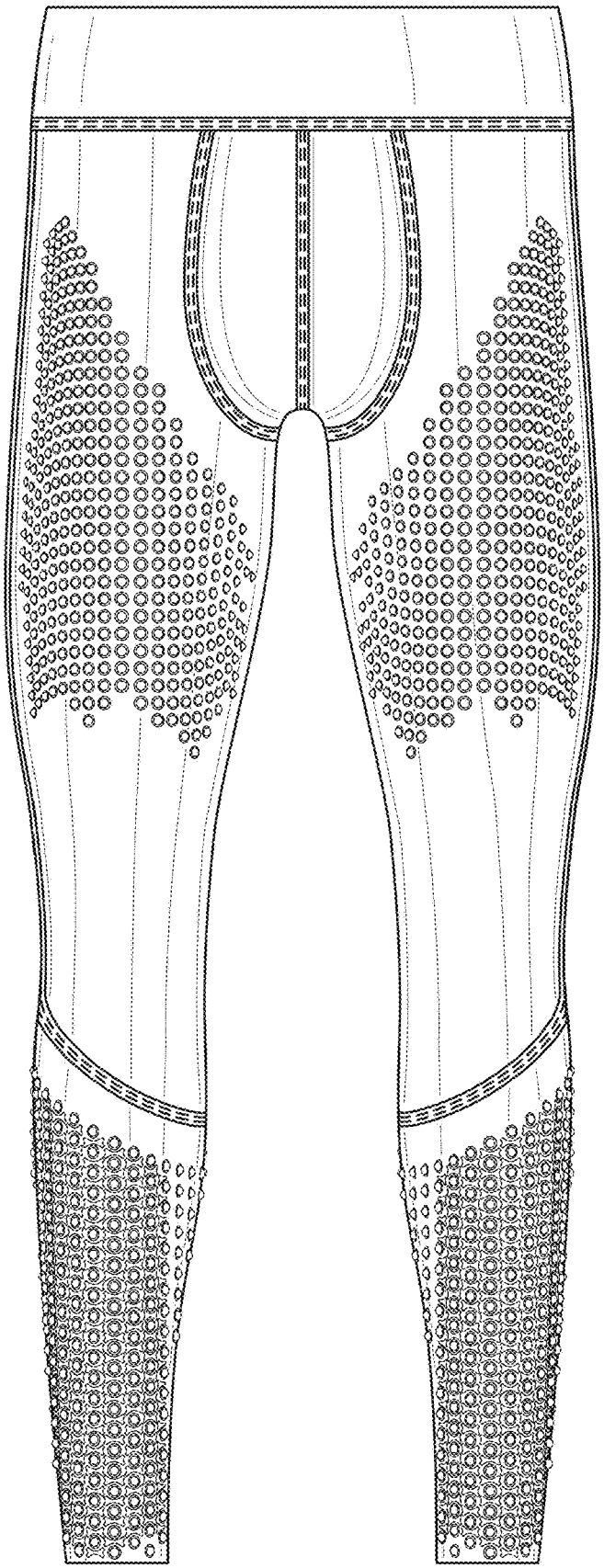
FIG. 52 illustrates a front view of an eighth example of a weighted apparel article in accordance with certain implementations of the disclosed technology.

FIG. 52 illustrates a front view of an eighth example of a weighted apparel article in accordance with certain implementations of the disclosed technology.

Figure 53:
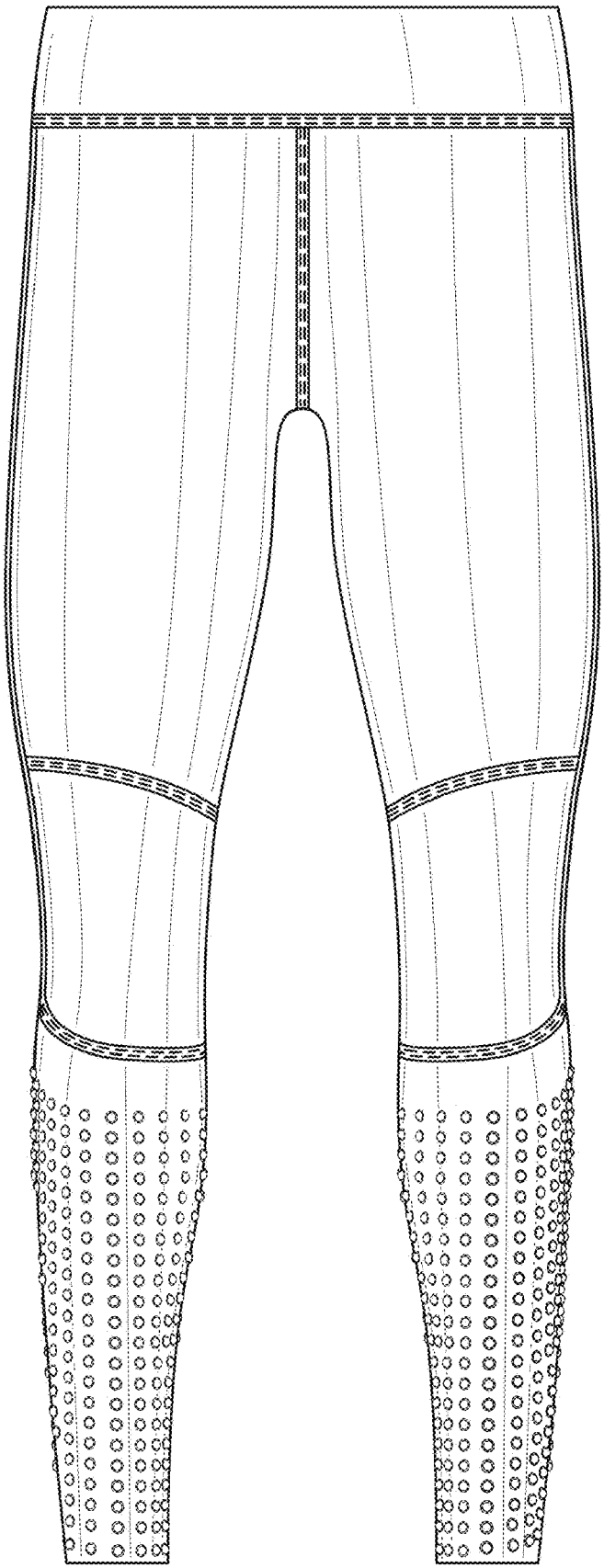
FIG. 53 illustrates a rear view of the weighted apparel article illustrated by FIG. 52.

FIG. 53 illustrates a rear view of the weighted apparel article illustrated by FIG. 52.

Figure 54:
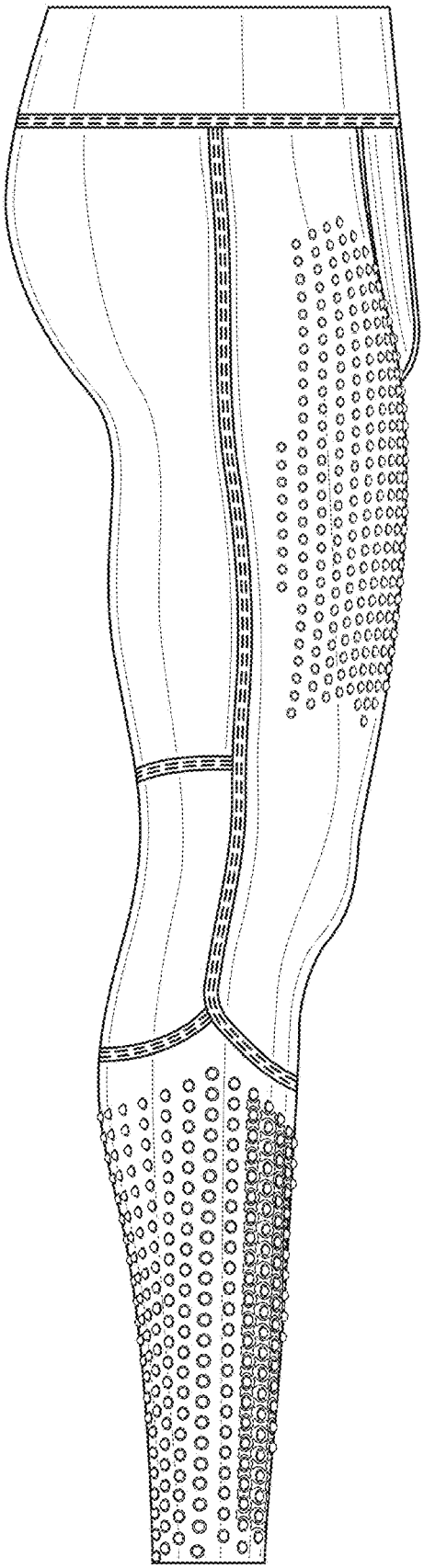
FIG. 54 illustrates a right side view of the weighted apparel article illustrated by FIG. 52.

FIG. 54 illustrates a right side view of the weighted apparel article illustrated by FIG. 52.

Figure 55:
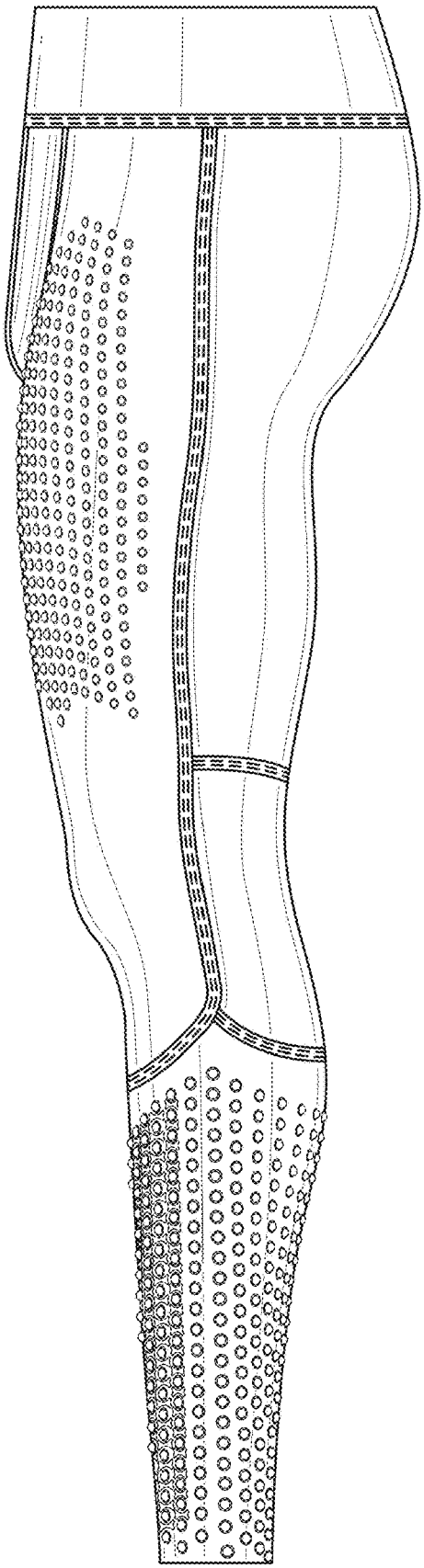
FIG. 55 illustrates a left side view of the weighted apparel article illustrated by FIG. 52.

FIG. 55 illustrates a left side view of the weighted apparel article illustrated by FIG. 52.

Figure 56:
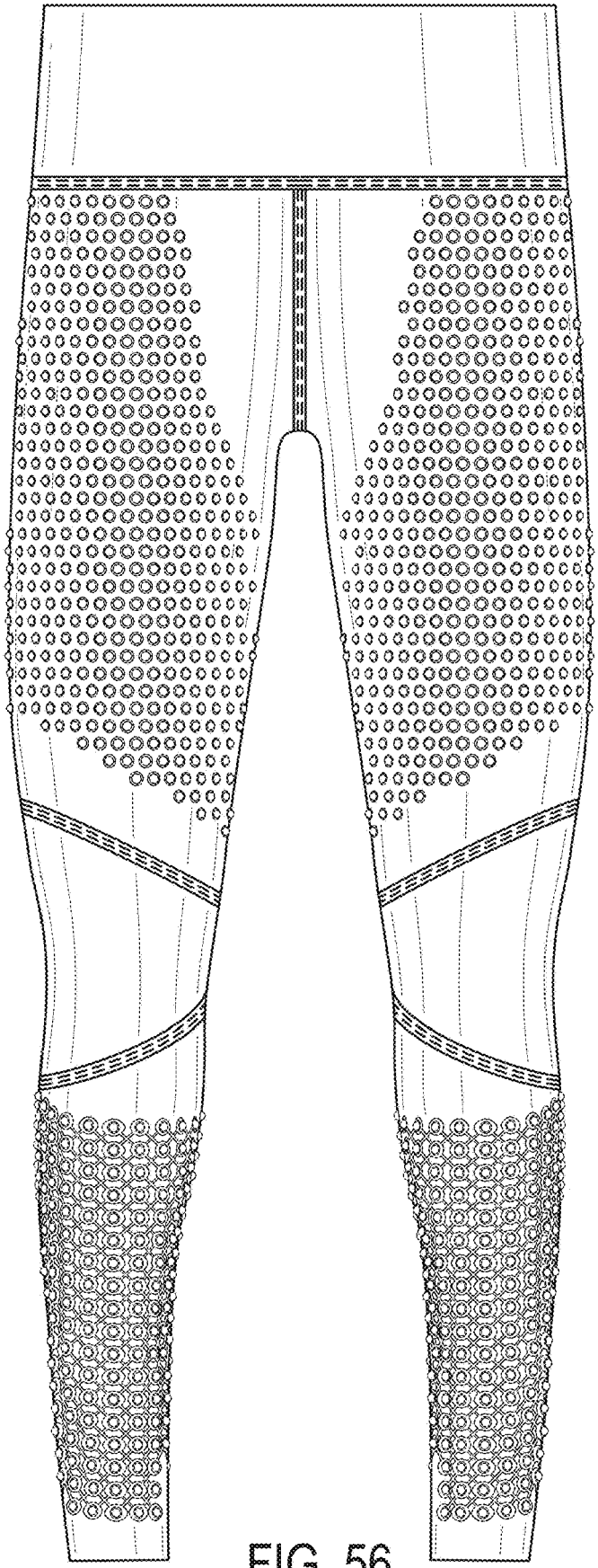
FIG. 56 illustrates a front view of a ninth example of a weighted apparel article in accordance with certain implementations of the disclosed technology.

FIG. 56 illustrates a front view of a ninth example of a weighted apparel article in accordance with certain implementations of the disclosed technology.

Figure 57:
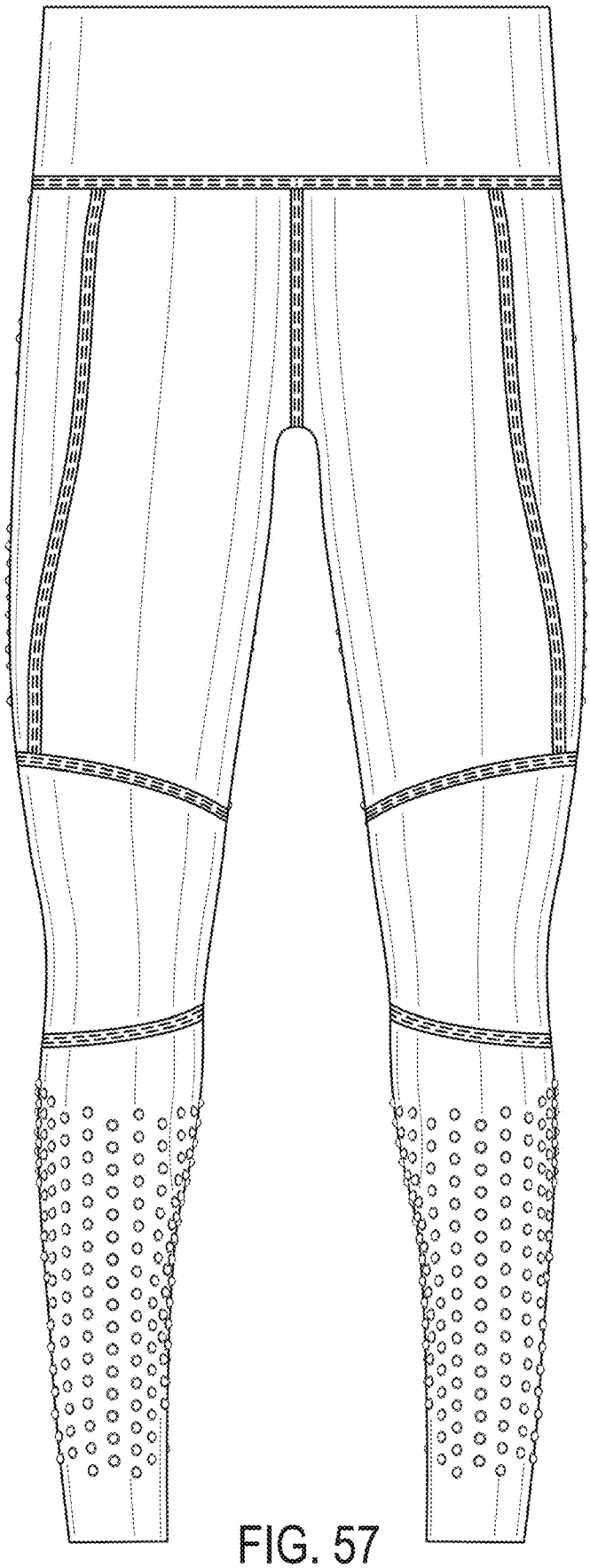
FIG. 57 illustrates a rear view of the weighted apparel article illustrated by FIG. 56.

FIG. 57 illustrates a rear view of the weighted apparel article illustrated by FIG. 56.

Figure 58:
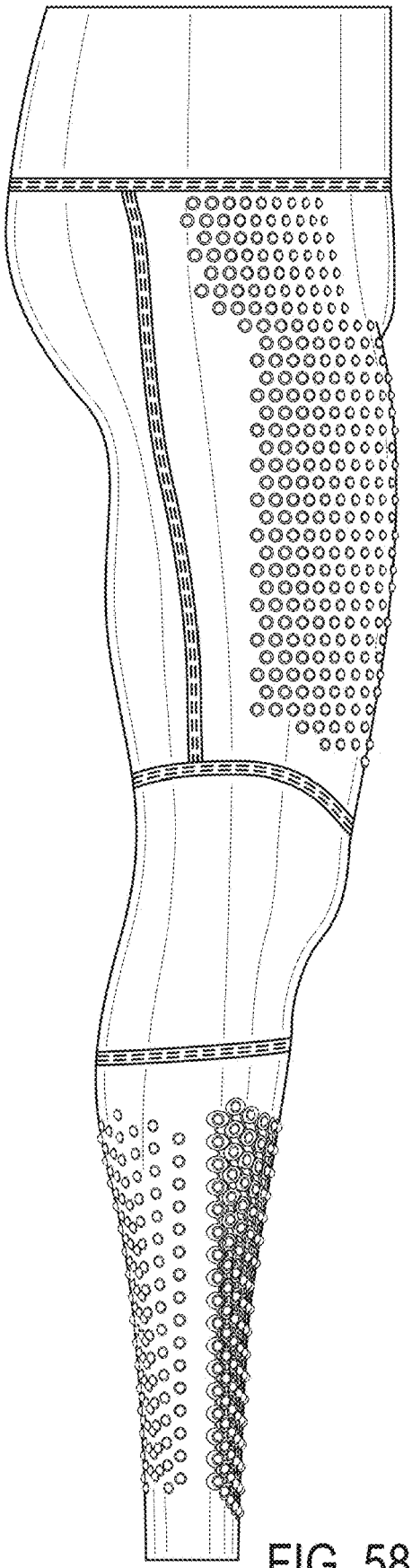
FIG. 58 illustrates a right side view of the weighted apparel article illustrated by FIG. 56.

FIG. 58 illustrates a right side view of the weighted apparel article illustrated by FIG. 56.

Figure 59:
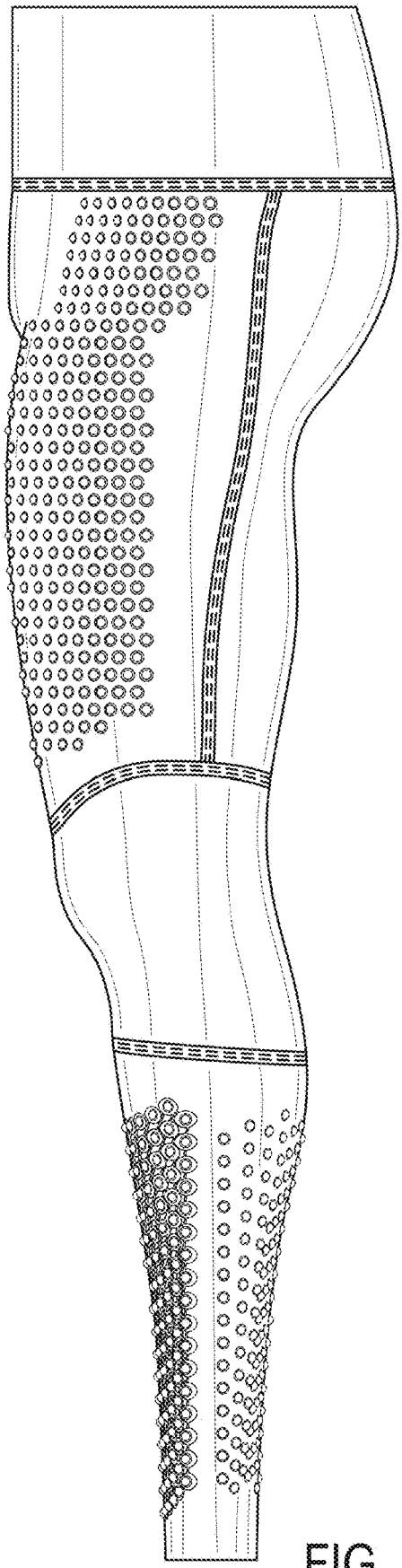
FIG. 59 illustrates a left side view of the weighted apparel article illustrated by FIG. 56.

FIG. 59 illustrates a left side view of the weighted apparel article illustrated by FIG. 56.

It will be appreciated that, while the disclosure describes systems and methods configured for personal fitness sessions, such systems and methods may also be used by a user in connection with group fitness sessions.

Aspects of the disclosure may operate on particularly created hardware, firmware, digital signal processors, or on a specially programmed computer including a processor operating according to programmed instructions. The terms controller or processor as used herein are intended to include microprocessors, microcomputers, Application Specific Integrated Circuits (ASICs), and dedicated hardware controllers. One or more aspects of the disclosure may be embodied in computer-usable data and computer-executable instructions, such as in one or more program modules, executed by one or more computers (including monitoring modules), or other devices.

Generally, program modules include routines, programs, objects, components, data structures, etc. that perform particular tasks or implement particular abstract data types when executed by a processor in a computer or other device. The computer executable instructions may be stored on a computer readable storage medium such as a hard disk, optical disk, removable storage media, solid state memory, Random Access Memory (RAM), etc. As will be appreciated by one of skill in the art, the functionality of the program modules may be combined or distributed as desired in various aspects. In addition, the functionality may be embodied in whole or in part in firmware or hardware equivalents such as integrated circuits, FPGA, and the like. Particular data structures may be used to more effectively implement one or more aspects of the disclosure, and such data structures are contemplated within the scope of computer executable instructions and computer-usable data described herein.

The disclosed aspects may also be implemented as instructions carried by or stored on one or more or computer-readable storage media, which may be read and executed by one or more processors. Such instructions may be referred to as a computer program product. Computer-readable media, as discussed herein, means any media that can be accessed by a computing device. By way of example, and not limitation, computer-readable media may comprise computer storage media and communication media.

Computer storage media means any medium that can be used to store computer-readable information. By way of example, and not limitation, computer storage media may include RAM, ROM, Electrically Erasable Programmable Read-Only Memory (EEPROM), flash memory or other memory technology, Compact Disc Read Only Memory (CD-ROM), Digital Video Disc (DVD), or other optical disk storage, magnetic cassettes, magnetic tape, magnetic disk storage or other magnetic storage devices, and any other volatile or nonvolatile, removable or non-removable media implemented in any technology. Computer storage media excludes signals per se and transitory forms of signal transmission.

Aspects of the present disclosure operate with various modifications and in alternative forms. Specific aspects have been shown by way of example in the drawings and are described in detail herein below. However, it should be noted that the examples disclosed herein are presented for the purposes of clarity of discussion and are not intended to limit the scope of the general concepts disclosed to the specific examples described herein unless expressly limited. As such, the present disclosure is intended to cover all modifications, equivalents, and alternatives of the described aspects in light of the attached drawings and claims.

References in the specification to embodiment, aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described regarding a particular aspect, such feature, structure, or characteristic can be employed in connection with another disclosed aspect whether or not such feature is explicitly described in conjunction with such other disclosed aspect.

Although specific examples of the invention have been illustrated and described for purposes of illustration, it will be understood that various modifications may be made without departing from the spirit and scope of the invention. Accordingly, the invention should not be limited except as by the appended claims.

What is claimed is:

1. A system for use in personal fitness, comprising:

an article of clothing configured to be worn by a user during a personal fitness session, the article of clothing having a fabric layer and at least one weighted portion formed by either or both polyurethane (PU) and thermoplastic polyurethane (TPU) printed on the fabric layer the weighted porting being sufficiently heavy to provide weighted resistance to the user;

a personal electronic device having a processor; and a communication unit integrated with the article of clothing and configured to interact with the personal electronic device, wherein the communication unit includes a near field communication (NFC) device or a QR code, and further wherein the processor is configured to launch a personal fitness application responsive to the user interacting with the NFC device or QR code.

2. The system of claim 1, wherein the personal fitness application is selected from the group consisting of: real-time coaching, a training program, and a connection with at least one other user.

3. The system of claim 1, wherein the article of clothing is selected from the group consisting of: a vest, a shirt, a compression shirt, a pair of pants, a pair of shorts, and a jacket.

4. The system of claim 1, wherein the at least one weighted portion covers a majority of the surface area of the fabric layer.

5. The system of claim 1, wherein the PU and/or TPU is printed such that the weight of the at least one weighted portion is distributed substantially evenly over the fabric.

6. The system of claim 1, wherein the personal electronic device is selected from the group consisting of: a tablet and a smartphone.

7. A method, comprising:

a user wearing an article of clothing during a personal fitness session, the article of clothing having a fabric layer and at least one weighted portion formed by either or both polyurethane (PU) and thermoplastic polyurethane (TPU) printed on the fabric layer the weighted porting being sufficiently heavy to provide weighted resistance to the user, the article of clothing also having a communication unit that includes a near field communication (NFC) device or a QR code;

the user interacting with the NFC device or QR code; and a processor launching a personal fitness application responsive to the user interacting with the NFC device or QR code.

8. The method of claim 7, further comprising the processor identifying the article of clothing and pairing with the communication unit responsive to the user interacting with the NFC device or QR code.

9. The method of claim 7, further comprising the personal fitness application prompting the user to create a new account or log into an existing account.

10. The method of claim 7, further comprising the personal fitness application unlocking at least one daily live workout optimized for use with the article of clothing.

11. The method of claim 10, further comprising the personal fitness application saving live session statistics to the user's account.

12. The method of claim 11, further comprising the personal fitness application allowing the user to access statistics from previous personal fitness sessions.

13. The method of claim 10, further comprising the personal fitness application allowing a trainer to interact with the user.

14. The method of claim 13, further comprising the personal fitness application providing the user with various types of information pertaining to the trainer and fitness activity associated with the trainer.

15. The method of claim 10, further comprising the personal fitness application connecting the user with a plurality of other users for the at least one daily live workout.

16. The method of claim 15, further comprising the personal fitness application allowing a trainer to interact with the user and each of the plurality of other users.

17. The method of claim 15, further comprising the personal fitness application providing identification information pertaining to either or both the trainer and at least one of the plurality of other users.

18. The method of claim 10, further comprising the personal fitness application providing the user with an interface that the user may use to browse, select, and purchase certain items.

19. The method of claim 18, wherein the certain items include at least one type of weighted workout apparel that is distinct from the article of clothing.

20. The method of claim 19, wherein the at least one type of weighted workout apparel that is distinct from the article of clothing is selected from the following group: a vest, a shirt, a compression shirt, a pair of pants, a pair of shorts, and a jacket.

* * * * *